US007762786B2

(12) United States Patent
Taylor et al.

(10) Patent No.: US 7,762,786 B2
(45) Date of Patent: Jul. 27, 2010

(54) INTEGRATED FIRE PUMP CONTROLLER AND AUTOMATIC TRANSFER SWITCH

(75) Inventors: Zane A. Taylor, Winston-Salem, NC (US); Matthew T. Flyer, High Point, NC (US); Craig I. Miller, High Point, NC (US); Lawrence M. Hapeman, Archdale, NC (US)

(73) Assignee: Hubbell Incorporated, Orange, CT (US)

( * ) Notice: Subject to any disclaimer, the term of this patent is extended or adjusted under 35 U.S.C. 154(b) by 1403 days.

(21) Appl. No.: 11/045,482

(22) Filed: Jan. 31, 2005

(65) Prior Publication Data

US 2005/0183868 A1 Aug. 25, 2005

Related U.S. Application Data

(60) Provisional application No. 60/539,987, filed on Jan. 30, 2004.

(51) Int. Cl.
*F04B 49/00* (2006.01)

(52) U.S. Cl. ..... 417/18; 307/23; 307/64; 169/51; 700/283

(58) Field of Classification Search ..... 417/18; 307/23, 39, 64; 169/24, 61, 51, 16; 702/183; 700/283

See application file for complete search history.

(56) References Cited

U.S. PATENT DOCUMENTS 3,403,954 A * 10/1968 Williams ..... 312/351
3,544,235 A 12/1970 Smith
3,859,565 A 1/1975 Henningsen
3,974,879 A 8/1976 Nelson, Jr. et al.
4,611,290 A * 9/1986 Henningsen et al. ..... 700/283
5,221,189 A * 6/1993 Henningsen ..... 417/12
5,950,150 A * 9/1999 Lloyd et al. ..... 702/183
6,172,432 B1 * 1/2001 Schnackenberg et al. ..... 307/23

OTHER PUBLICATIONS

Underwriters Laboratories, Inc. (UL), Standard for Fire Pump Controllers, Feb. 1, 1996.

National Fire Protection Association (NFPA) 20 Centrifugal Fire Pumps, 1980 Edition, National Fire Protection Association Batterymarch Park, Quincy, MA 02269 (published Jun. 11, 1980).

National Fire Protection Association (NFPA) 20 Centrifugal Fire Pumps, 1987 Edition, National Fire Protection Association Batterymarch Park, Qunicy, MA 02269 (published Feb. 12, 1987).

Firetrol, Inc. Fire Pump Control Division FTA975, FTA976 Product Description Power Transfer Switches for Limited Service Controllers (published Apr. 1997).

(Continued)

*Primary Examiner*—Devon C Kramer
*Assistant Examiner*—Peter J Bertheaud
(74) *Attorney, Agent, or Firm*—Garrett V. Davis; Mark S. Bicks; Alfred N. Goodman

(57) ABSTRACT

A unitary fire pump controller and transfer switch assembly is housed in a single cabinet having a fire resistant barrier dividing the cabinet into at least two separate compartments. A fire pump controller device is contained within a first compartment. An automatic transfer switch is contained in the second compartment and separated from the control device by the barrier.

21 Claims, 21 Drawing Sheets

OTHER PUBLICATIONS

Firetrol, Inc. Fire Pump Control Division "Limited Service Controllers and Power Transfer Switches" (copyright 2002).

Firetrol, Inc. Pump Control Division Dimensions and Shipping Weight for FTA750, FTA975 and FTA976 (published Jan. 30, 1996, Jan. 7, 1998, Jan. 8, 1998).

Firetrol, Inc. Fire Pump Control Division Wiring Schematic Limited Service Fire Pump Controller with Power Transfer Switch for FTA750, FTA975 pp. 1-2 (published Nov. 22, 1996).

Firetrol, Inc,. Fire Pump Control Division, Field Connections Limited Service Fire Pump Controller with Power Transfer Switch for FTA750, FTA975 pp. 1-2 (published Jan. 3, 1997).

Firetrol, Inc., Fire Pump Control Division Field, Instructions—Limited Service Controllers, FTA750 pp. 1-4 (published May 1997).

Firetrol, Inc. Fire Pump Control Division Field, "Sequence of Operation: Limited Service Controllers, FTA750" pp. 1-2 (published Dec. 1996).

Firetrol, Inc. Fire Pump Control Division Field, "Sequence of Operation: Power Transfer Switch, FTA900", pp. 1-2 (published Feb. 1998).

Firetrol, Inc. Shop Order 69257-FED, including Bill of Lading, Firetrol Options Test Report, Component Picklist of Material Bill, Sales note to customer, and Layout LY750-100 drawing (shipped Aug. 2, 1996).

Firetrol, Inc. Shop Order 69873-FEX, including Bill of Lading, Firetrol Options Test Report, Material Bill, and Descriptive Publication DP750-20 (shipped Sep. 16, 1996).

Master Control Systems, Inc. Lake Bluff, Illinois MC Transfer Switch Fire Pump Controller Table of Contents and related drawings WB14099 published Apr. 22, 1994; Dec. 26, 1989; 9070 Sep. 18, 1990, 9083 Jun. 11, 1992).

Master Control Systems, Inc., Limited Service Transfer Switch Fire Pump Controllers (Nov. 1, 1990).

* cited by examiner

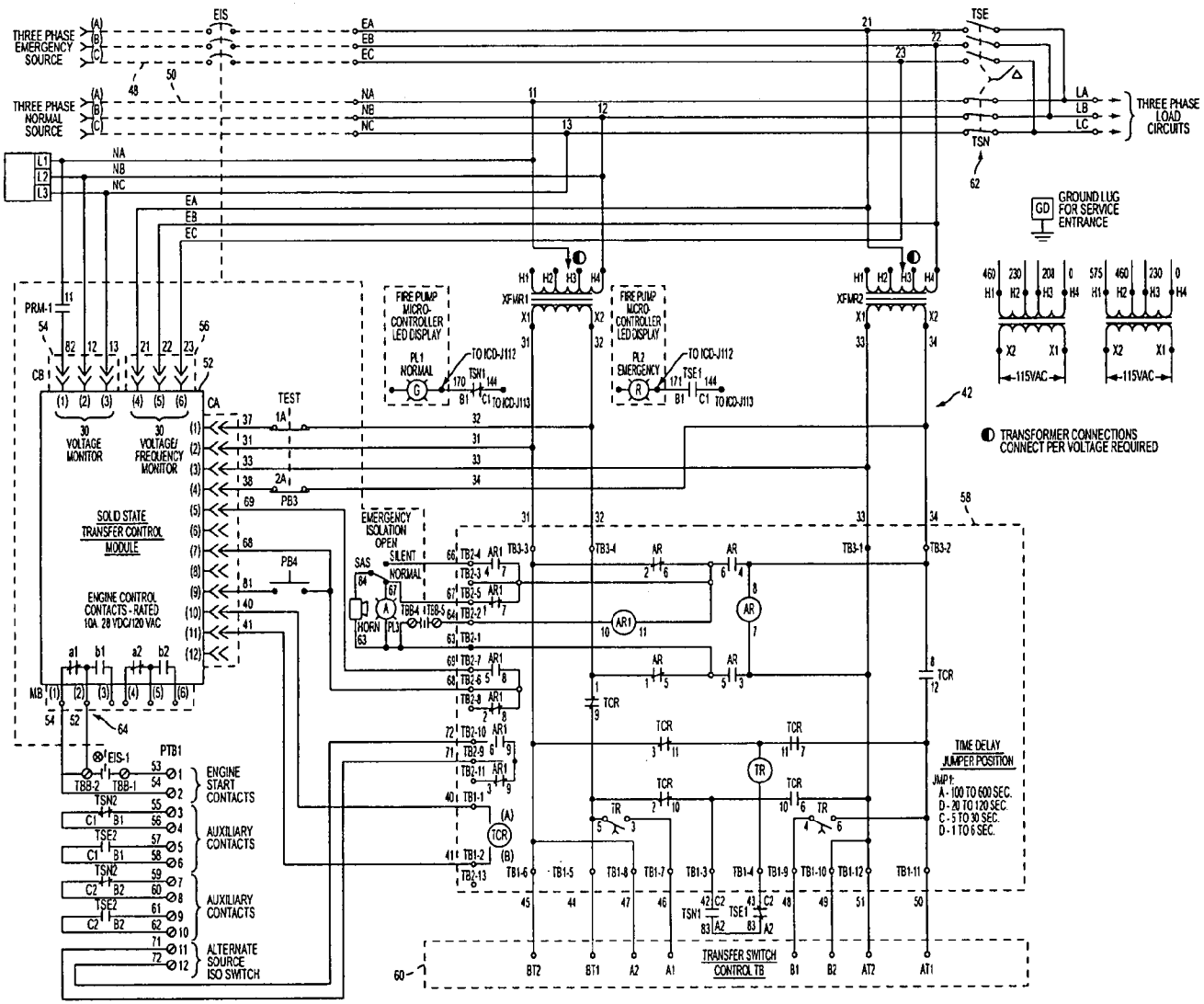
FIG. 6 MAP

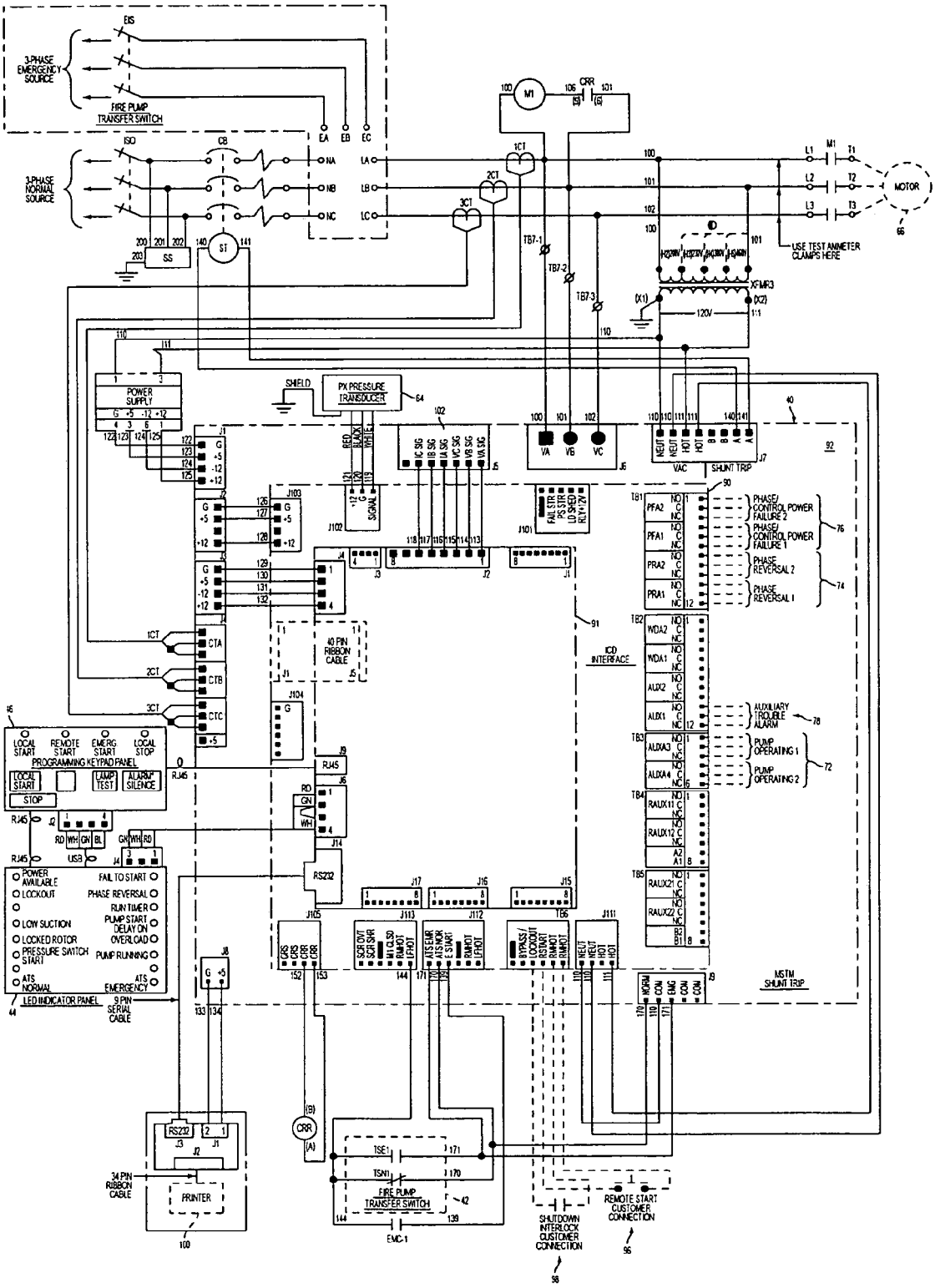
FIG. 7 MAP

INTEGRATED FIRE PUMP CONTROLLER AND AUTOMATIC TRANSFER SWITCH

This application claims the benefit of U.S. Provisional Patent Application No. 60/539,987 filed Jan. 30, 2004, which is hereby incorporated by reference in its entirety.

FIELD OF THE INVENTION

The present invention is directed to a fire controller and transfer switch assembly. The invention is particularly directed to a fire pump controller and automatic transfer switch that is assembled in a single cabinet having a reduced form factor.

BACKGROUND OF THE INVENTION

Fire pump control systems are commonly used in large buildings to control the flow of water to sprinkler heads as part of a fire suppression system. A fire pump control system operates a pump system for directing high pressure water to the sprinkler heads.

The pump control system is connected to various fire detectors and sensors and activates a pump in the event of a fire to supply the water to the desired location. The control system typically controls the water pressure, flow rate, starting of the pump and the stopping of the pump.

In a building or location where the electrical power supply is limited or unreliable, a gasoline or diesel powered generator can be used to provide electrical power to operate the water pump. Diesel engines used in fire suppression systems are required to be operated periodically and typically once a week to ensure proper operation. The testing operation requires that various measurements be made and recorded to establish compliance with the appropriate codes and regulations that govern fire suppression systems, for example, water pressure level, flow rate, fuel level and operating time and frequency. These operating functions and recorded measurements are stored and analyzed by a suitable microprocessor so that selected information can be recovered by the operator.

Some fire suppression systems that include an internal combustion engine to provide electrical power to the pump mechanism are able to operate on electrical power supplied through standard utility power lines. A number of these fire suppression systems are able to operate alternatively with electrical power supplied through the utility lines, or electrical power supplied by a generator operated by the internal combustion engine. Current regulations require that the control system for operating the pump, valves, and the like, be separate from the switching mechanism that switches between a primary power source such as an AC power source provided via utility lines and the back-up generator. The control system and transfer switch are assembled in separate housings or cabinets. These devices typically require large amounts of floor space which increases the difficulty of constructing and assembling such systems and decreases efficient use of limited pump room or utility room floor space.

The electric motors that operate the pumps are generally large and powerful and require large amounts of electrical power. In particular, these large electrical motors require large amounts of electrical power to start the motors which can cause sudden increases and decreases in the water pressure within the water pipes of the system. These sudden changes in water pressure, and particularly a sudden increase in water pressure, can cause damage to the valves, pumps, pressure regulators and other equipment.

To overcome the problem associated with sudden water pressure changes, systems have been developed to control the voltage supplied to the electric motors that operate the pumps. Reducing the starting voltage can be attained by the design of the motor. The reduced voltage enables the motor to start at slower speeds to reduce the surging and sudden increase in water pressure. As the voltage increases, the motor speed increases to attain the desired water pressure. The controlled starting of the electric motors is commonly referred to as soft start. Examples of soft start motors are disclosed in U.S. Pat. No. 5,221,189 to Henningsen, U.S. Pat. No. 3,859,565 to Henningsen and U.S. Pat. No. 4,611,290 to Henningsen, which are hereby incorporated herein by reference.

As stated above, some existing fire pump control devices are used in conjunction with a transfer switch assembly to ensure electrical power is continuously supplied to the pump control system, even during an outage of the primary power source. The transfer switches of these prior devices are provided in a separate enclosure according to current regulations and are connected to the pump control system by a suitable electrical connection. These prior devices, with their separate transfer switching enclosures, are mounted side-by-side, and thus, require a significant amount of floor space. For example, U.S. Pat. No. 5,221,189 discloses a fire pump controller having separate cabinets for the starting components and the main fire pump control.

Various fire pump control systems have been developed to supply water under pressure to a fire suppression system. Examples of such systems are disclosed in U.S. Pat. No. 3,974,879 and U.S. Pat. No. 3,544,235 which are hereby incorporated by reference in their entirety. These devices have been generally effective for their intended purpose but have not overcome all of the limitations and deficiencies of the prior systems. Accordingly, there is a continuing need in the industry for an improved fire pump control system.

SUMMARY OF THE INVENTION

The present invention is directed to a self-contained unitary assembly for a fire pump controller and transfer switch. The assembly in a preferred embodiment includes a single cabinet or case that defines one or more enclosures for the electrical components of the fire pump controller.

In one embodiment of the invention, the cabinet includes a first compartment and at least one second compartment separated from the first compartment by an intermediate internal wall. In preferred embodiments, the cabinet and the internal wall are made of steel or other fire resistant material. In one embodiment, the cabinet has a substantially rectangular shape with the internal wall extending between the opposite side walls and contiguous with the rear wall. Preferably, the first and second compartments are stacked in a vertical relationship to reduce the floor space that is required for the assembly. The stacked arrangement provides a unitary assembly that satisfies building code regulations and minimizes space requirements for the assembly.

The assembly of the present invention eliminates the need for separate cabinets or enclosures, reduces the amount of wiring between the components, and enables the elimination of duplicate components. By providing a single cabinet with an internal wall to define a first compartment for the pump control system and a second compartment for the transfer switch, the space requirements for the assembly is significantly reduced.

The various aspects of the invention are attained by providing a fire pump control assembly comprising a metal fire resistant cabinet having a first side wall, a second side wall, a top wall extending between the side walls, a bottom wall extending between the side walls and a rear wall to define an enclosure. An intermediate internal wall is provided to form a first compartment and a second compartment. The cabinet has an open front side that is closed by a door. Preferably, a single door is coupled to the cabinet for simultaneously closing the open front side of the first and second compartments. A fire pump control device is housed completely within the first compartment. An automatic transfer switch assembly is housed completely within the second compartment and physically separated from the fire pump control.

The various aspects of the invention are further attained by providing an automatic self-contained fire pump assembly for operating an electric motor coupled to a water pump for supplying water to a fire suppression system of a building where the assembly comprises a cabinet having first and second side walls, a top wall, a bottom wall and a back wall with an open front side. An intermediate internal wall extends between the side walls and is contiguous with the back wall to define a first compartment and a second compartment where the second compartment is separate from the first compartment. A door is coupled to the cabinet for closing the open front side of the first and second compartments. A fire pump control device is completely housed in the first compartment for controlling electric power to the electric pump motor of the fire suppression system. A transfer switch device is completely housed in the second compartment for continuously maintaining an electric power supply to the control device where the transfer switch is operatively connected to the control device.

These and other aspects of the invention will become apparent from the following detailed description of the invention and the annexed drawings which disclosed preferred embodiments of the invention.

BRIEF DESCRIPTION OF THE DRAWINGS

The various objects, advantages and novel features of the present invention will be best understood by reference to the detailed description of the preferred embodiments which follows, when read in conjunction with the accompanying drawings, in which:

FIG. 6 is a schematic map diagram of an automatic transfer switch for use with a fire pump controller in accordance with an embodiment of the present invention;

FIG. 7 is a schematic map diagram of fire pump controller and automatic transfer switch combination constructed in accordance with an embodiment of the present invention;

DETAILED DESCRIPTION OF THE PREFERRED EMBODIMENT

Figure 1:
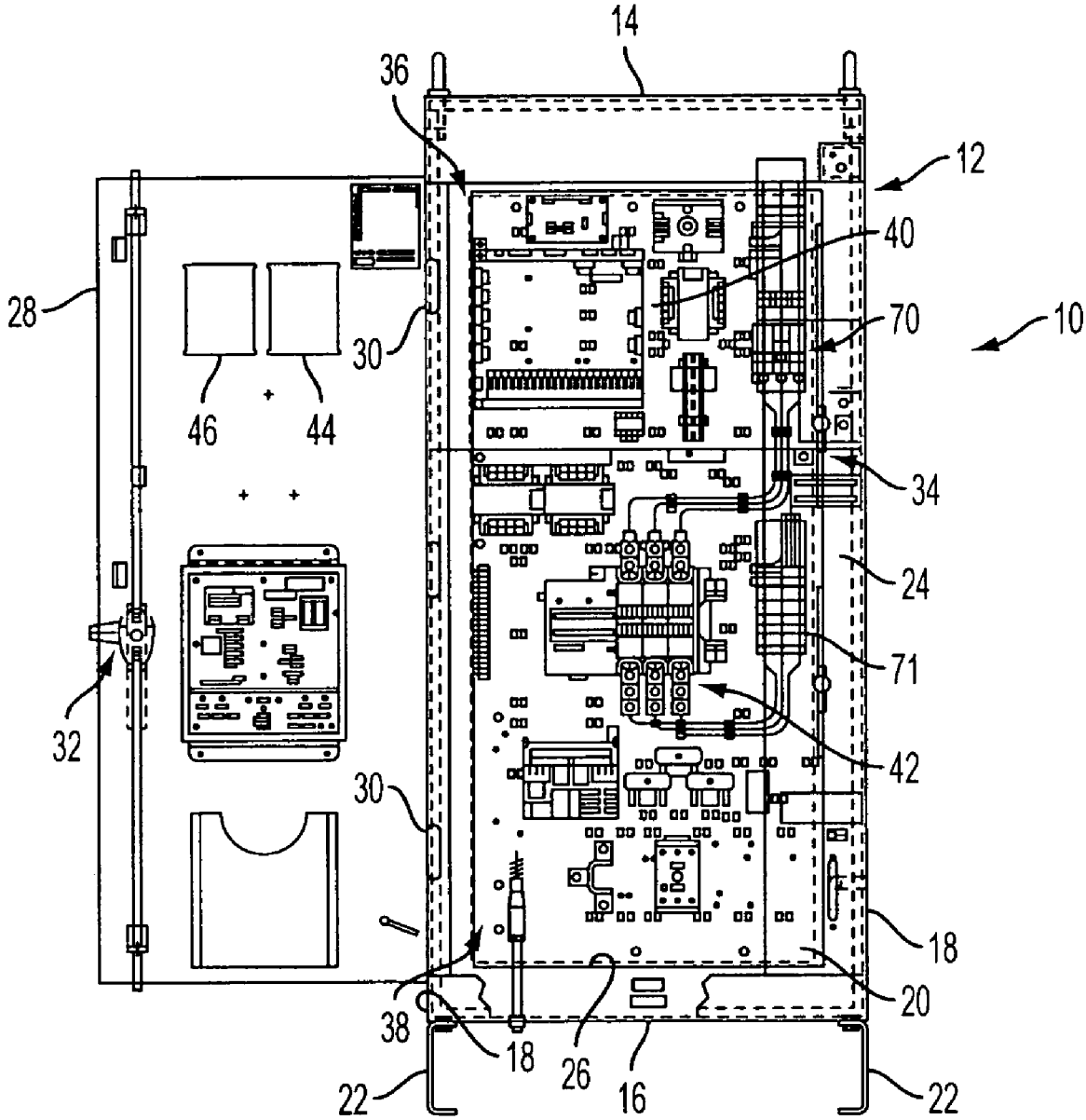
FIG. 1 is a front elevational view of a fire pump controller and transfer switch assembly constructed in accordance with an embodiment of the present invention.

The present invention is directed to a unitary housing for enclosing and supporting the electrical components of a fire pump control system. The invention is further directed to a self-contained fire pump controller and transfer switch assembly 10, as shown in FIG. 1. The fire pump controller and transfer switch assembly 10 is preferably provided in a pump room or utility area of a building, for example, where the pump for controlling the supply of water to the fire suppression system for the building is located, as well as a secondary energy source such as a secondary utility line or generator. The fire pump controller and transfer switch assembly 10 of the present invention is advantageous over conventional fire pump controller and power transfer systems because it employs a unitary cabinet that has a smaller footprint, and therefore requires less floor space. As described in further detail below, the fire pump controller and transfer switch assembly 10 is also configured to reduce assembly labor, shorten power cable runs used therein, and reduce wire stress, among other advantages.

Figure 2:
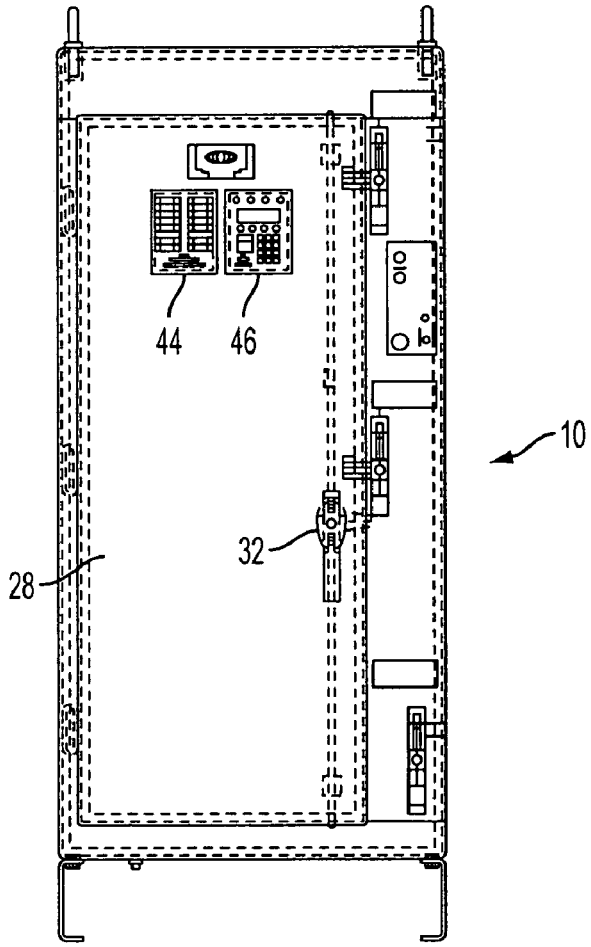
FIG. 2 is a back elevational view of the door depicted in FIG. 1.
Figure 3:
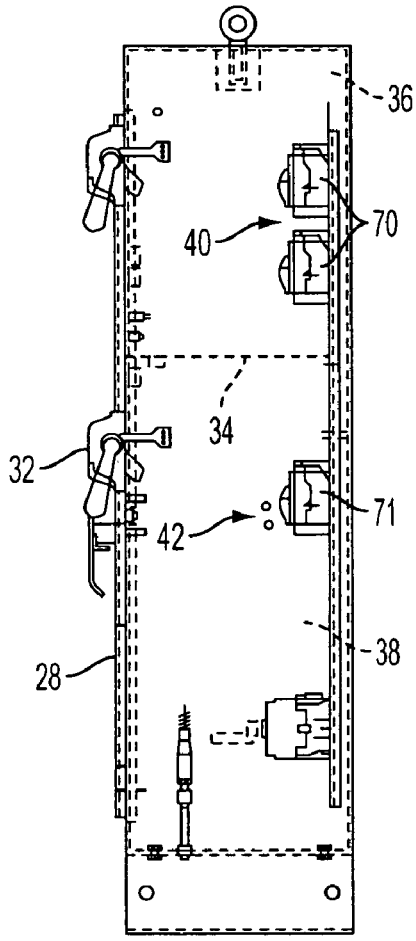
FIG. 3 is a side elevational view of the fire pump controller and transfer switch assembly depicted in FIG. 1.

Referring to FIGS. 1-3, the fire pump controller and transfer switch assembly 10 includes a cabinet 12 having a top wall 14, a bottom wall 16, opposite side walls 18 and a back wall 20. The back wall 20 is coupled to the side walls, top wall and bottom wall to form an enclosure. A pair of side panels forming legs 22 are coupled to bottom wall 16 to support and stabilize cabinet 12. In the embodiment shown, a front wall 24 having an access opening 26 is coupled to side walls 18 and top wall 14 and bottom wall 16. Access opening 26 is dimensioned to enable the worker to install and repair the various electrical components of the fire pump controller and transfer switch assembly. Typically, cabinet 12 is constructed from several fire resistant panels that are coupled together by suitable connections such as welding, riveting or the use of other fasteners. In one preferred embodiment, the panels that make up the side, top, bottom and back walls are made of steel. An access door 28 is mounted on front wall 24 by hinges 30 to close access opening 26. A suitable locking assembly 32 is provided on access door 28 to lock the door and prevent unauthorized access to the system components.

Cabinet 12 includes an internal intermediate wall 34 to separate the interior of the cabinet into a first compartment 36 and second compartment 38. In one embodiment, cabinet 12 has a substantially rectangular upright shape and internal wall 34 is oriented in a substantially horizontal position. Typically, internal wall 34 is made of steel and forms a fire resistant barrier between first compartment 36 and second compartment 38 that is able to satisfy all commercial fire, electrical and building codes. Internal wall 34 is typically fixed to opposite side walls 18 and back wall 20 where the edges abut the respective side and back walls without any gaps or openings between internal wall 34 and the opposite side walls 18 and back wall 20. Various openings (not shown), which can be knock-outs or pry-outs, are provided to enable electrical connections between the electrical components in the respective compartments. The openings through the internal wall 34 can include a suitable coupling member, clamp member or seal between the first compartment 36 and the second compartment 38 as required by the fire and electrical codes. Preferably, the openings in internal wall 34 are arranged with the electrical components in the compartments to provide the shortest run of electrical wiring between the electrical components.

Fire pump controller and transfer switch assembly 10 comprises a fire pump controller (FPC) indicated generally at 40 in FIG. 1 and an automatic transfer switch (ATS) indicated generally at 42. As shown in the embodiment of FIGS. 1-3, fire pump controller 40 is mounted within first compartment 36 and the automatic transfer switch 42 is primarily mounted within second compartment 38 so that the transfer switch assembly 42 is separated by internal wall 34 from fire pump controller 40. Internal wall 34 forms a fire resistant barrier separating fire pump controller 40 from transfer switch assembly 42.

Fire pump controller and transfer switch assembly 10 provides control and operation of a fire pump motor to supply water to sprinkler systems, stand pipes and other fire suppression systems. FPC 40 is operatively connected to an electric motor for driving a pump in the event of a fire to supply the water to the fire suppression system. Under normal operating conditions, controller 40 and the electric motor of the pump are operated by a primary three phase electrical power source indicated by lines 50 in FIG. 6. In the event of power failure, ATS 42 senses the power failure and automatically switches to an alternative or auxiliary power source indicated by lines 48 in FIG. 6 to ensure continuous and reliable operation of the fire suppression system. ATS 42 can switch to a different electrical circuit or power source to maintain power to the pump motor and controller 40. In other embodiments, ATS 42 can be operatively connected to power generator that can be driven by an internal combustion engine. ATS 42 is designed to automatically start the internal combustion engine in the even of a primary power failure to maintain operation of the pump motor and the fire suppression system.

The components of the FPC 40 and ATS 42 will be described in more detail below in connection with FIGS. 1, 6, 7 and 8 after the following general description of the respective operations of the FPC and ATS. FPC 40 is designed to control electric motors. In particular, the controller 40 controls the electric motors where the power source does not permit starting of the electric motor at full voltage. The controller 40 preferably provides soft start and stop operation of the electric motor to reduce mechanical and hydraulic stress on the plumbing of the fire suppression system.

The fire pump controller and transfer switch assembly 10 is factory assembled and wired to conform to the requirements of standard building codes. Preferably, the assembly 10 conforms to the requirements of NFPA-20 and NFPA-70 and are approved by Underwriter's Laboratories and Factory Mutual.

The fire pump controller 40 is preferably a combined manual and automatic type and is design tested and marked for the rated horsepower and three-phase voltage and frequency in a 40° C. ambient temperature. The FPC 40 has a common operating handle for both the line isolating switch and the controller circuit breaker that are mounted in the cabinet 12 and indicated generally at 70 in FIG. 1.

The minimum withstand rating for the fire pump controller and transfer switch assembly 10 when powered from a utility power source is preferably about 100,000 amps RMS symmetrical at 200-480 volts. The minimum withstand rating for the fire pump controller and transfer switch assembly 10 when powered from an engine driven generator source is 42,000 amps RMS symmetrical at 200-480 volts.

Fire pump controller 40 has separate and independent pressure settings and is capable of setting up a minimum run with a timing of 10 minutes. Settings of the pressures are established at the time of the field acceptance test. FPC 40 is also provided with switching to allow manual or automatic shutdown in the field. As shown in FIG. 7, FPC 40 comprises two sets of contacts each for pump running 72, phase reversal 74 and power/phase failure 76. A single set of contacts 78 is provided for a trouble indication. The contacts for the trouble indication are activated by an invalid configuration memory, emergency manual start, pump running, phase failure, phase reversal, overload, locked rotor, fail to start, and lock-out indicators.

The microcontroller(s) used in the FPC 40 is preferably a non-volatile flash-based complex programmable logic device and has a boot-up time of about three seconds or less. Programming of the FPC 40 is accomplished from a touch pad 46 mounted on the access door 28 of the assembly 10. Preferably, programming is password protected so that only authorized personnel can change the logic functions.

ATS 42 is electrically operated and can be mechanically held in both the normal and emergency power operation. Preferably, ATS 42 is rated for continuous duty in an unventilated enclosure. The transfer switch logic monitors the emergency power source for three phases before permitting transfer from the normal power source. The ATS 42 provides full phase protection for all phases of the normal and emergency power sources. The transfer and re-transfer time delays can be adjusted and the motor load decay time delay is provided to prevent breaker tripping when transferring large motor loads. ATS 42 also provides a test switch to simulate normal power failure and a phase loss and phase reversal monitor to initiate transfer to the emergency power source. Various audible and visual alarms are provided to indicate and isolate an open switch.

Figure 4:
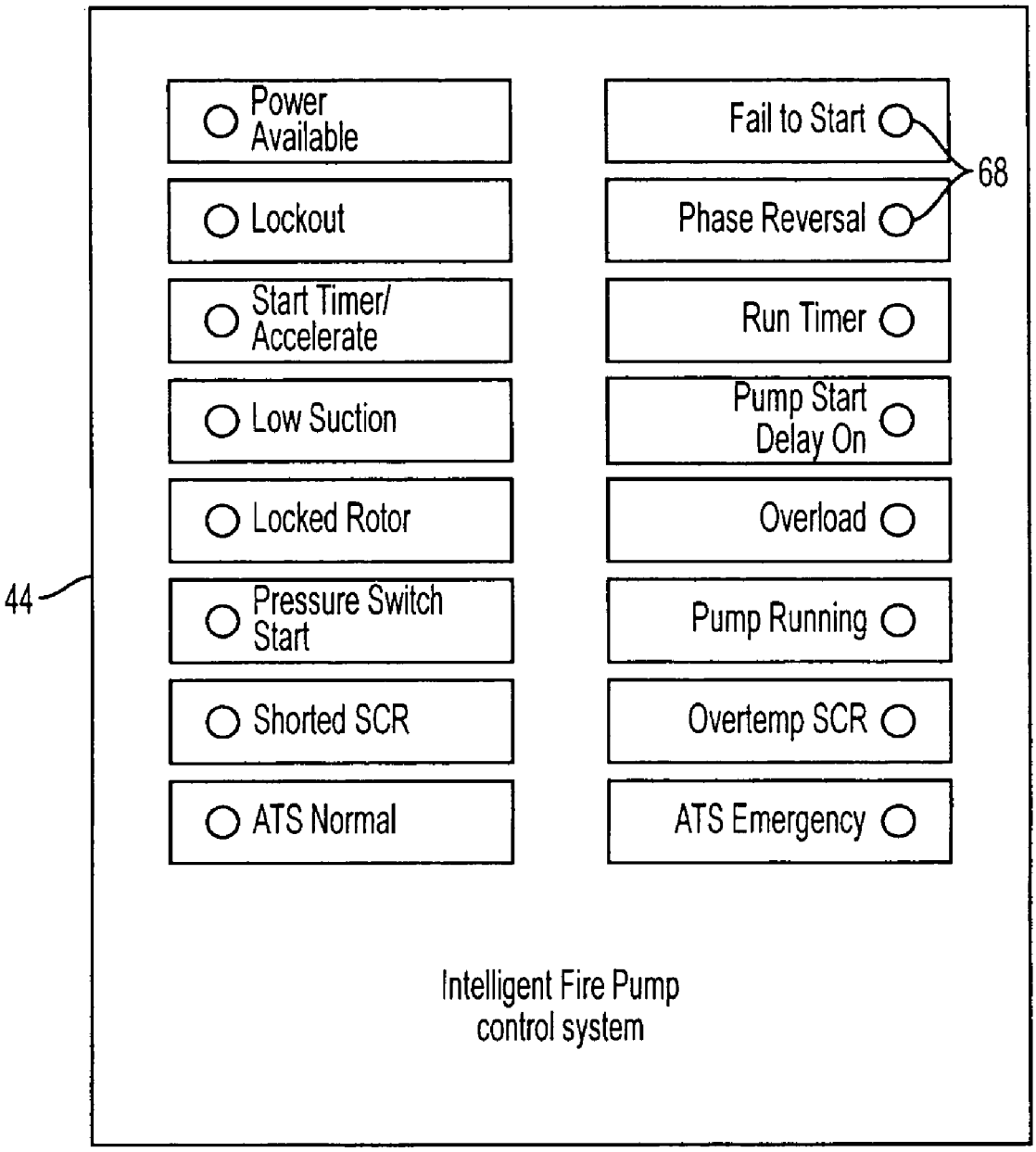
FIG. 4 is an LED display module for use with a fire pump controller and transfer switch assembly depicted in FIG. 1.
Figure 5:
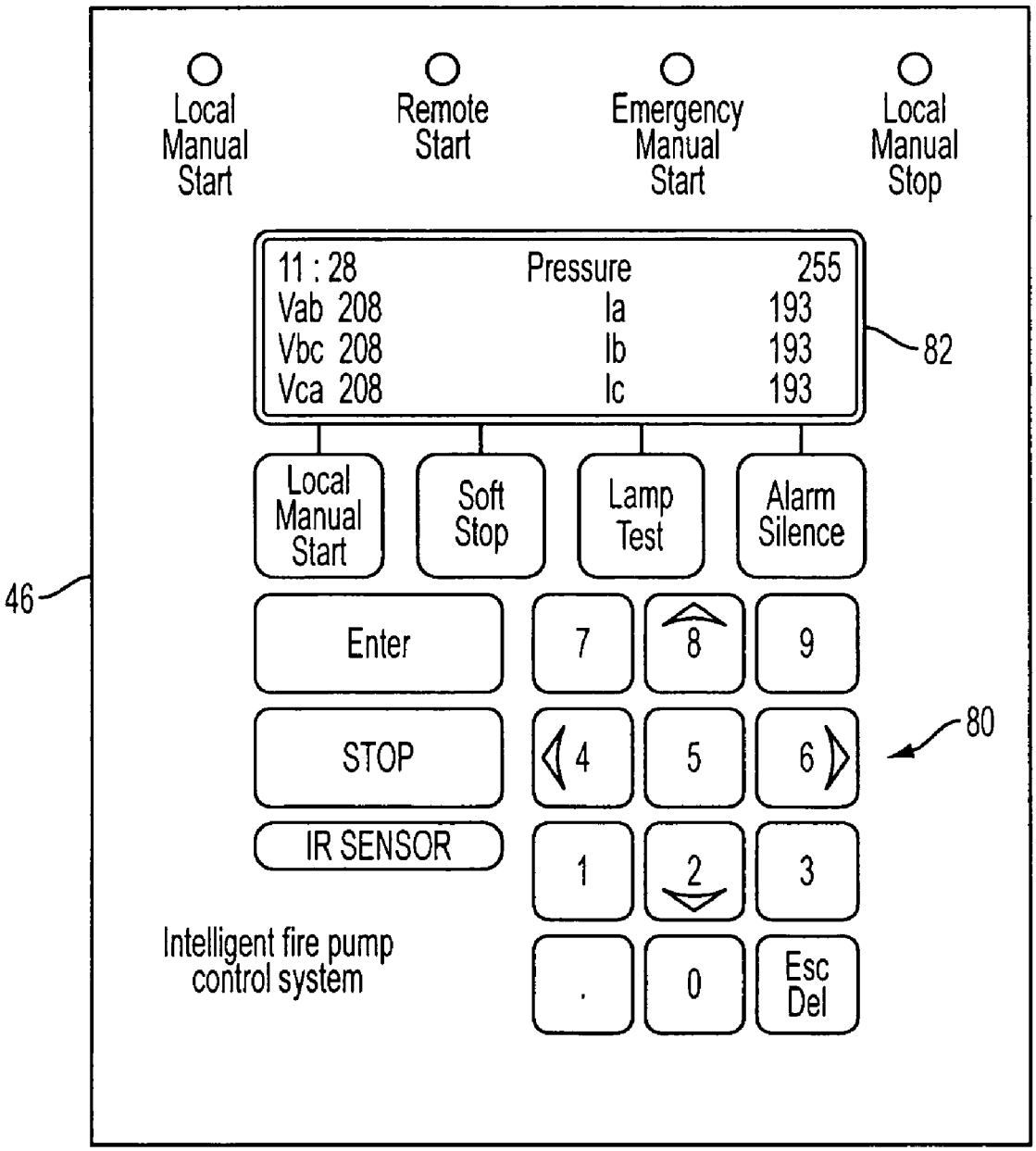
FIG. 5 is a keypad for use with the fire pump controller and transfer switch assembly depicted in FIG. 1.
Figure 6A:
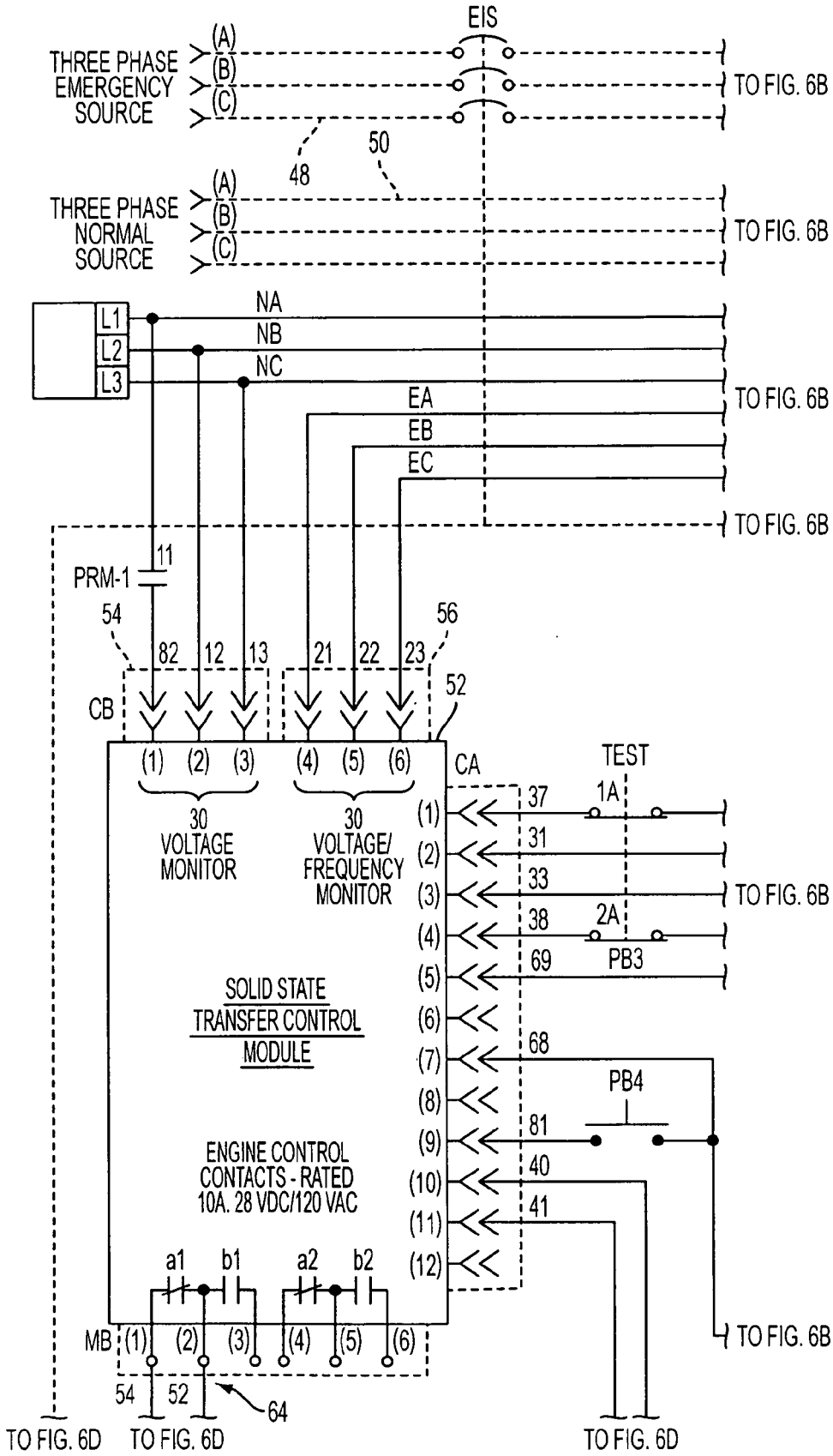
FIGS. 6A-6F are schematic diagrams of the sections of FIG. 6.
Figure 6B:
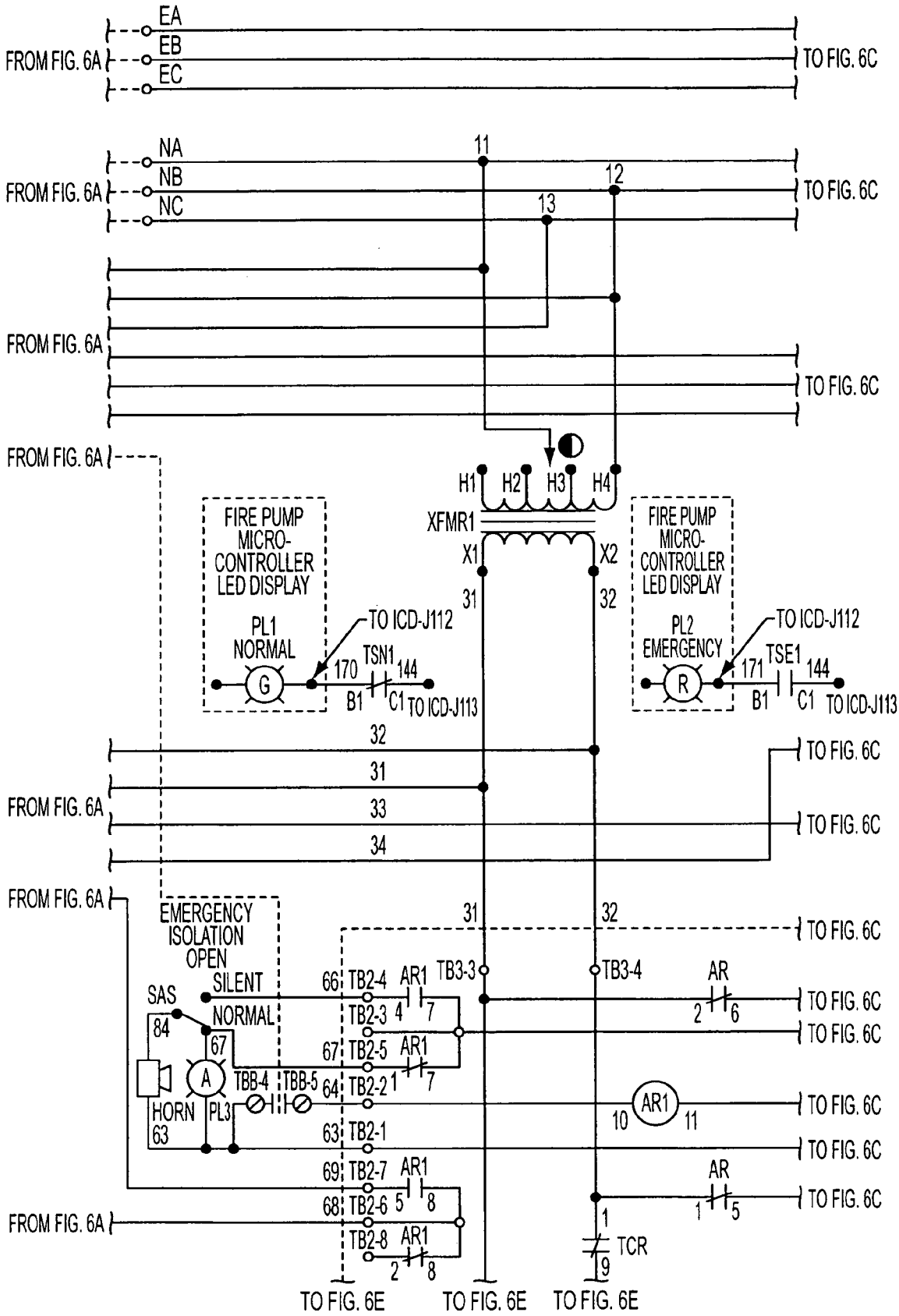
Figure 6C:
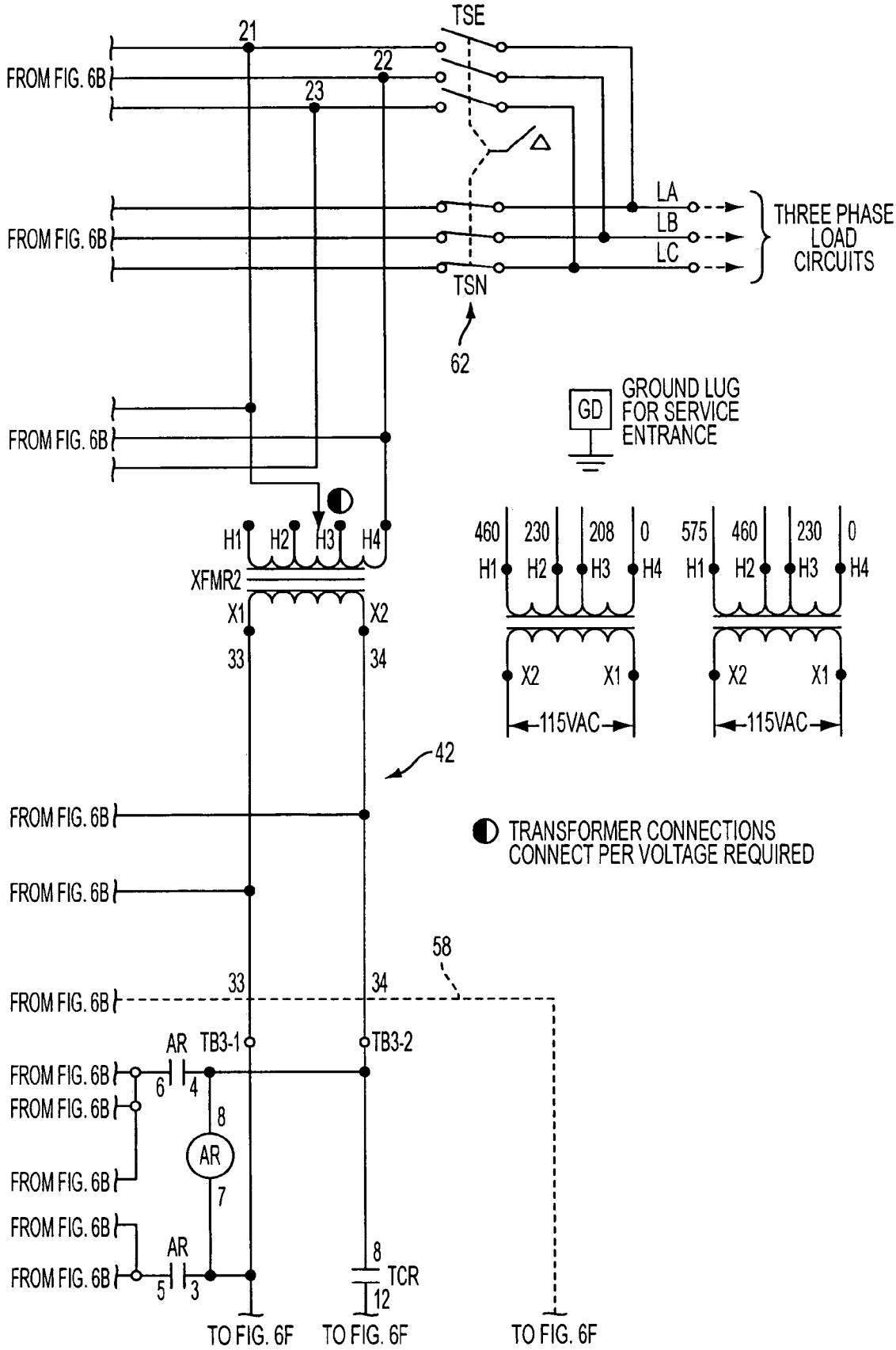
Figure 6D:
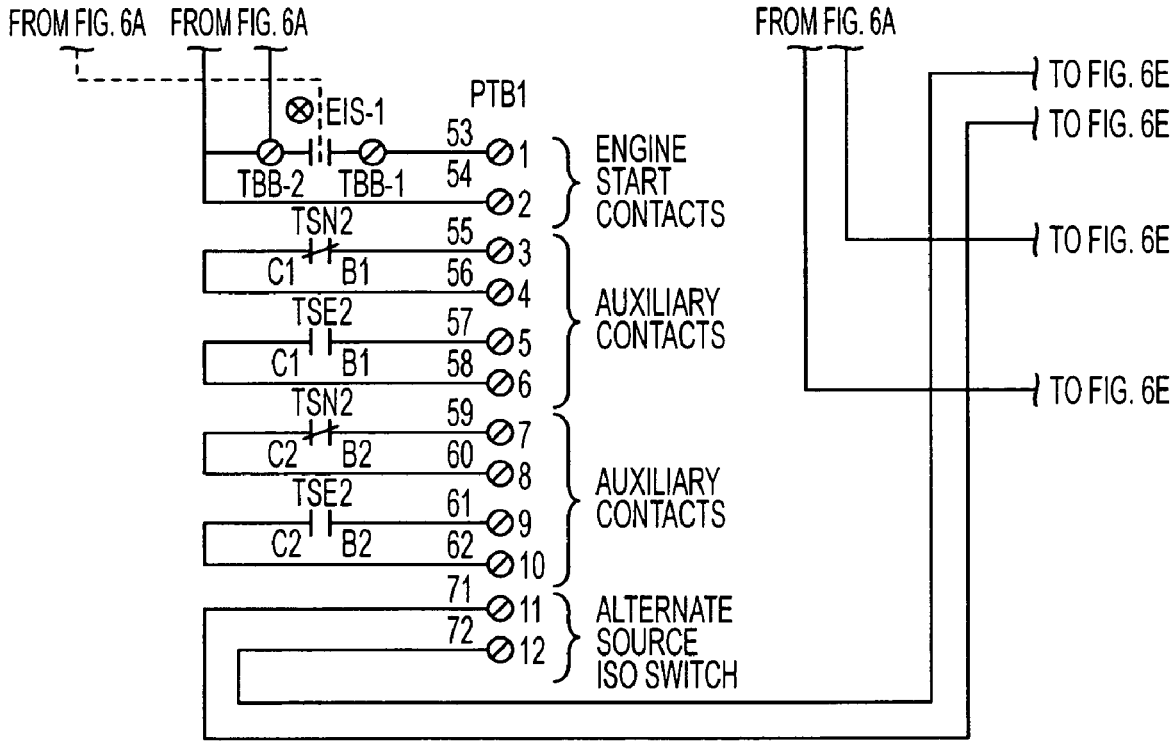
Figure 6E:
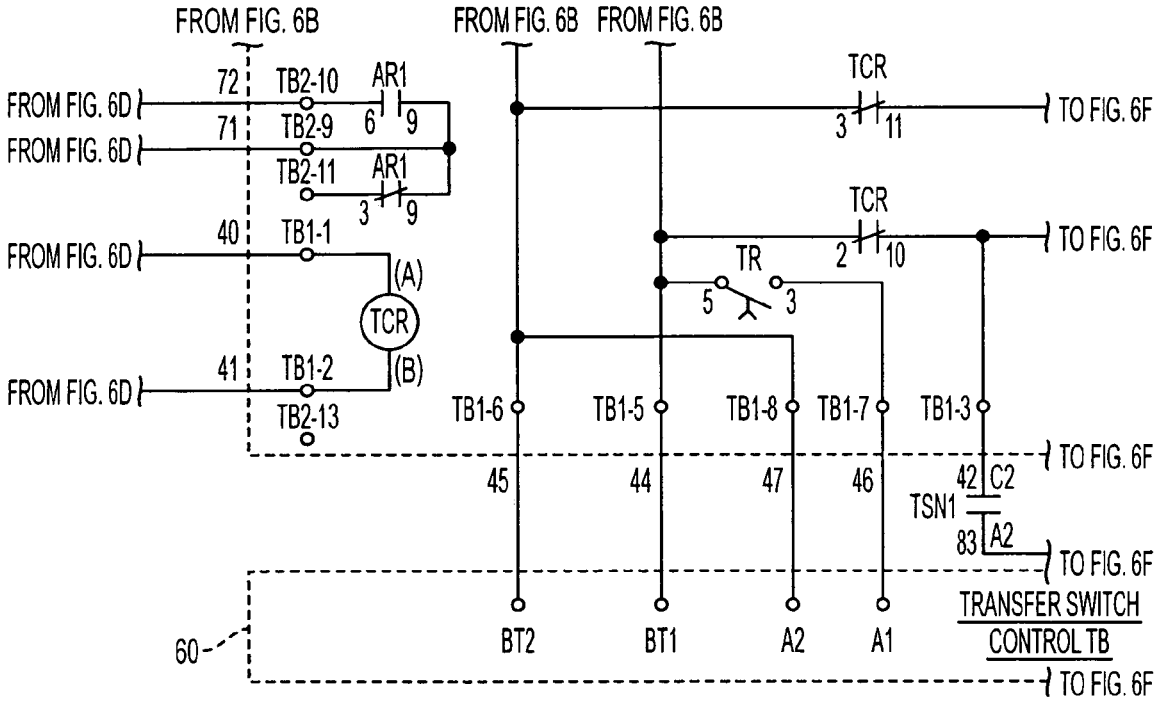
Figure 6F:
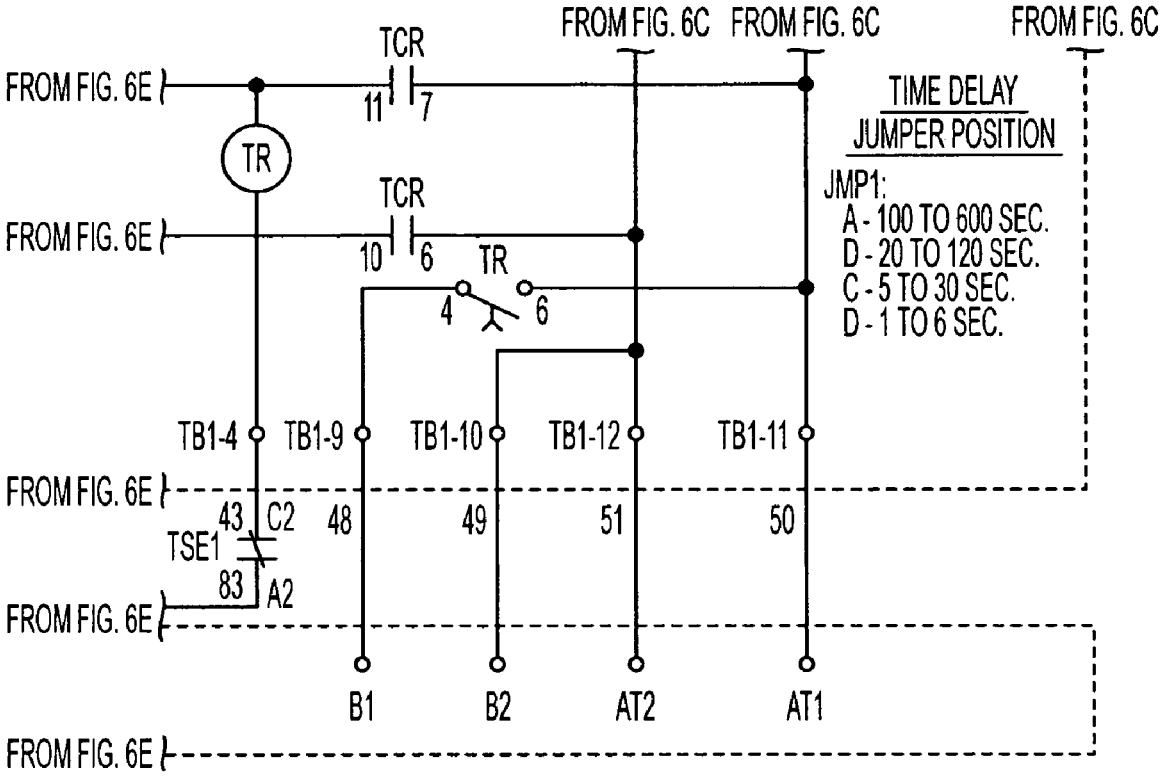
Figure 7A:
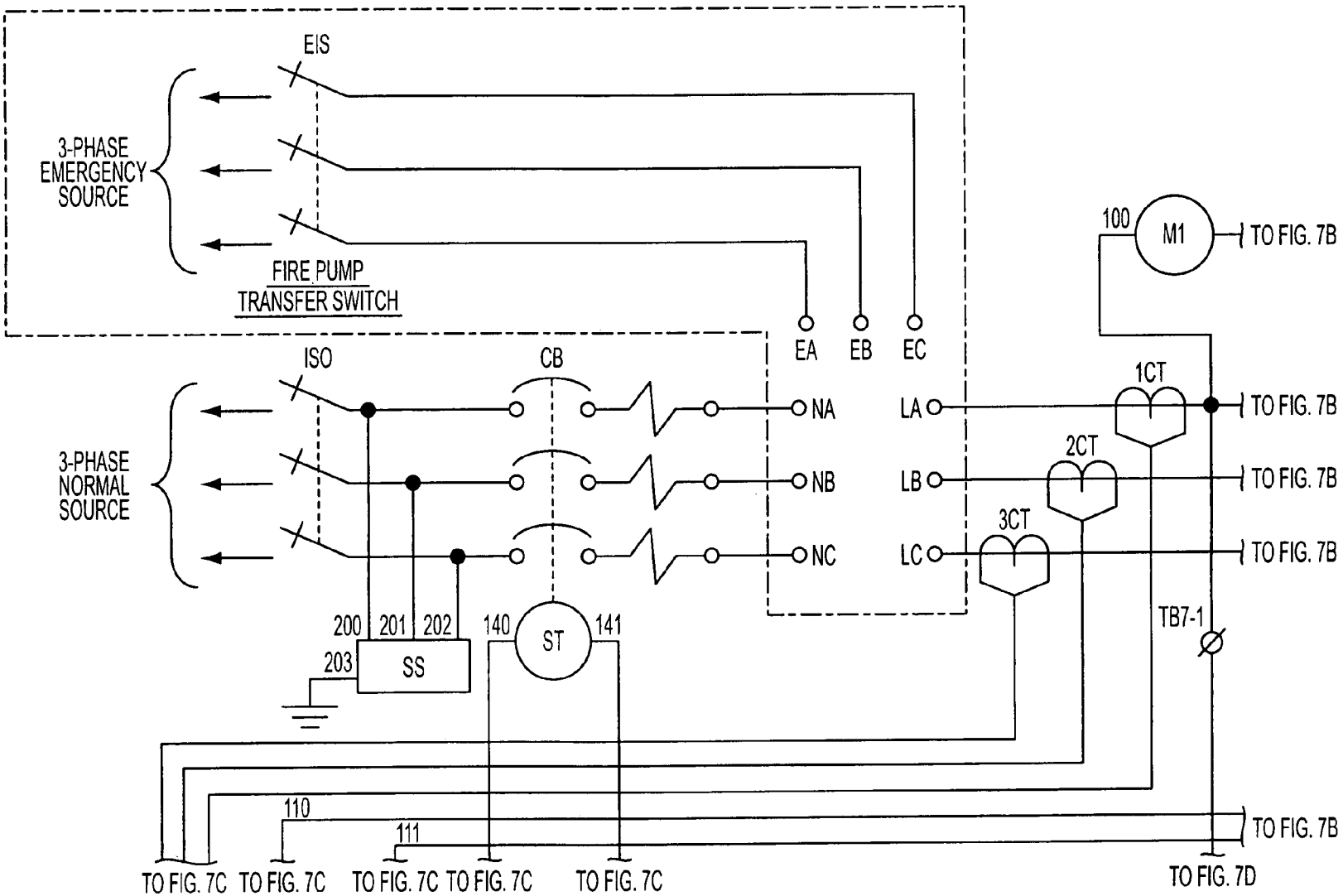
FIGS. 7A-7H are schematic diagrams of the sections of FIG. 7.
Figure 7B:
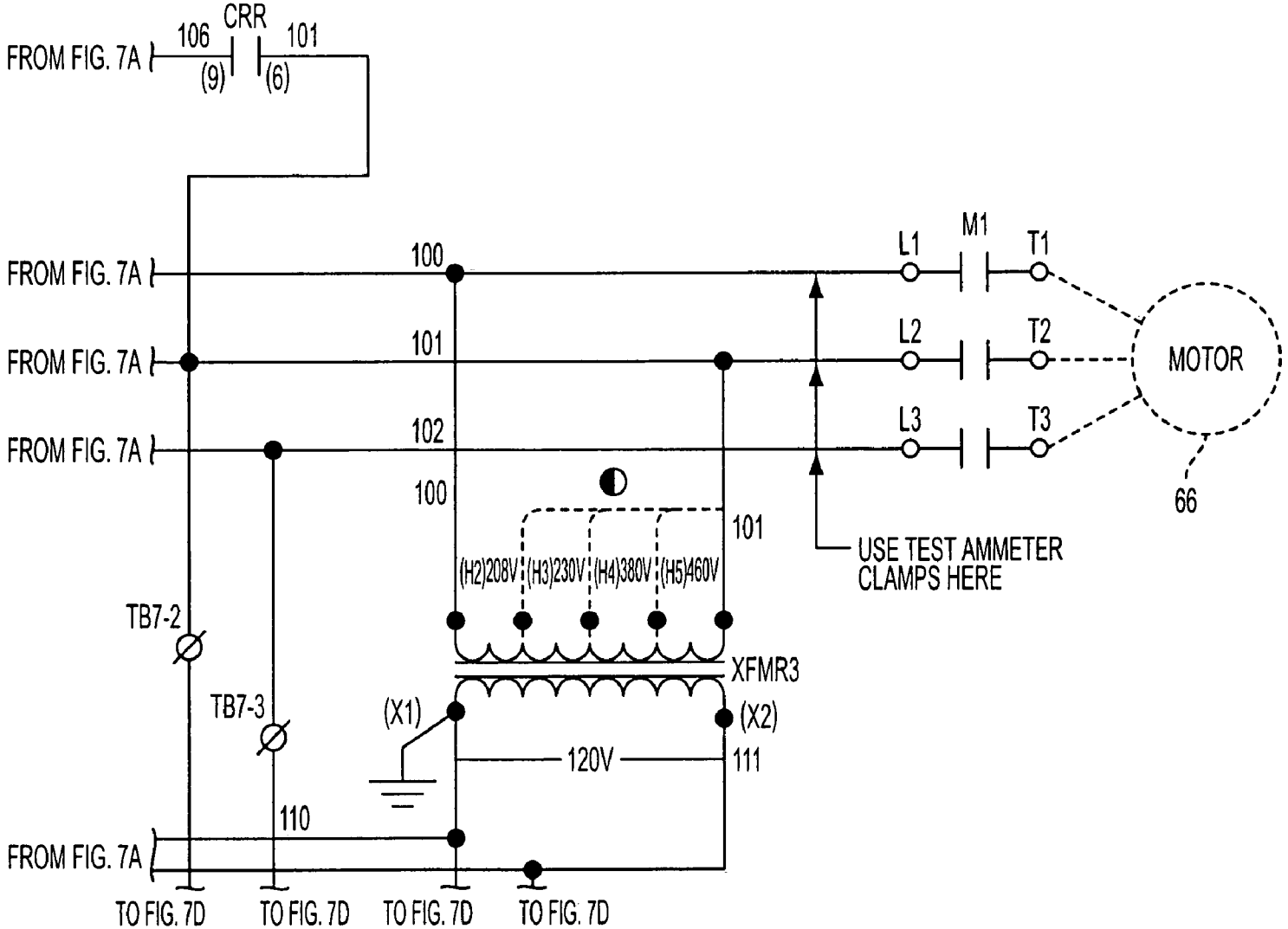
Figure 7C:
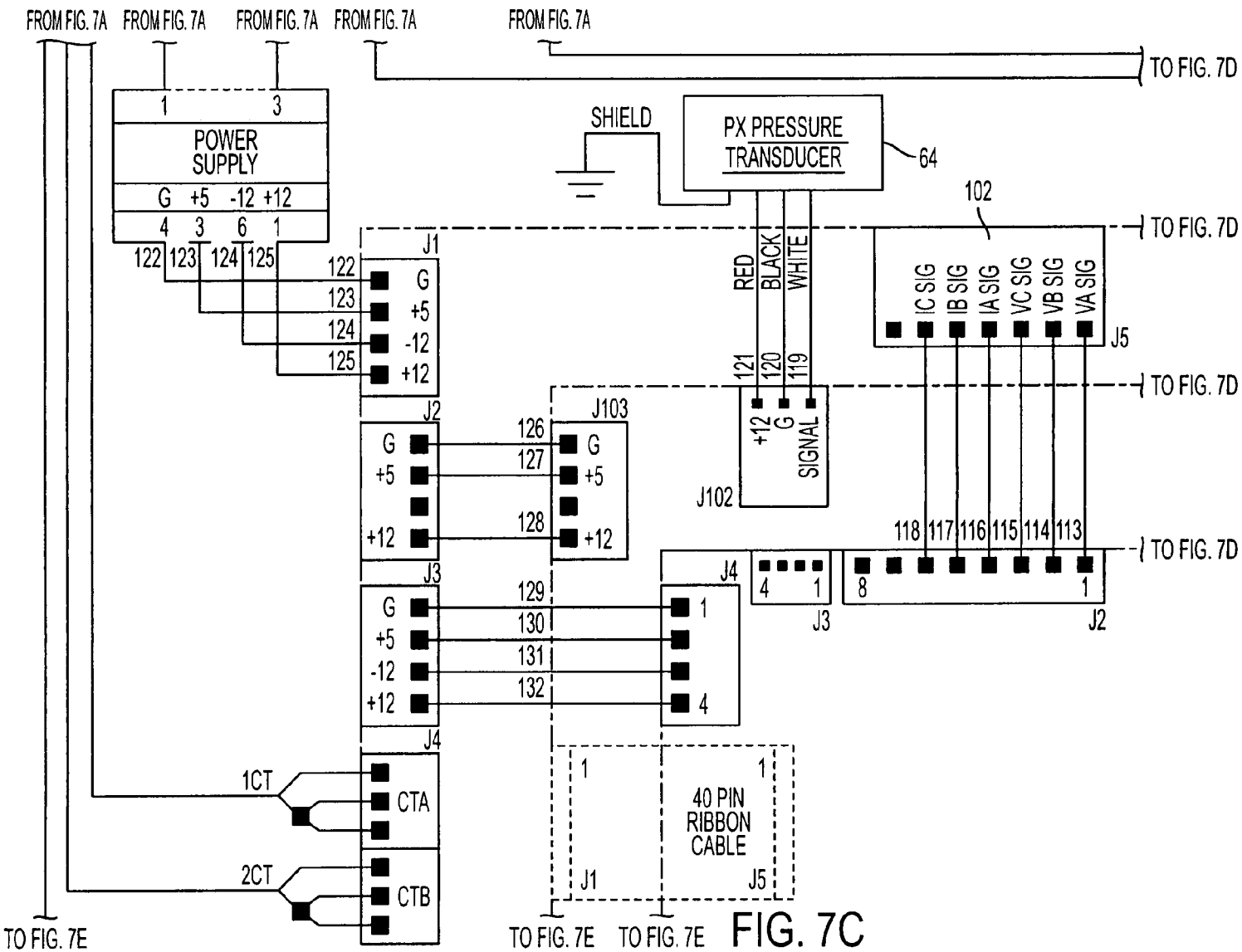
Figure 7D:
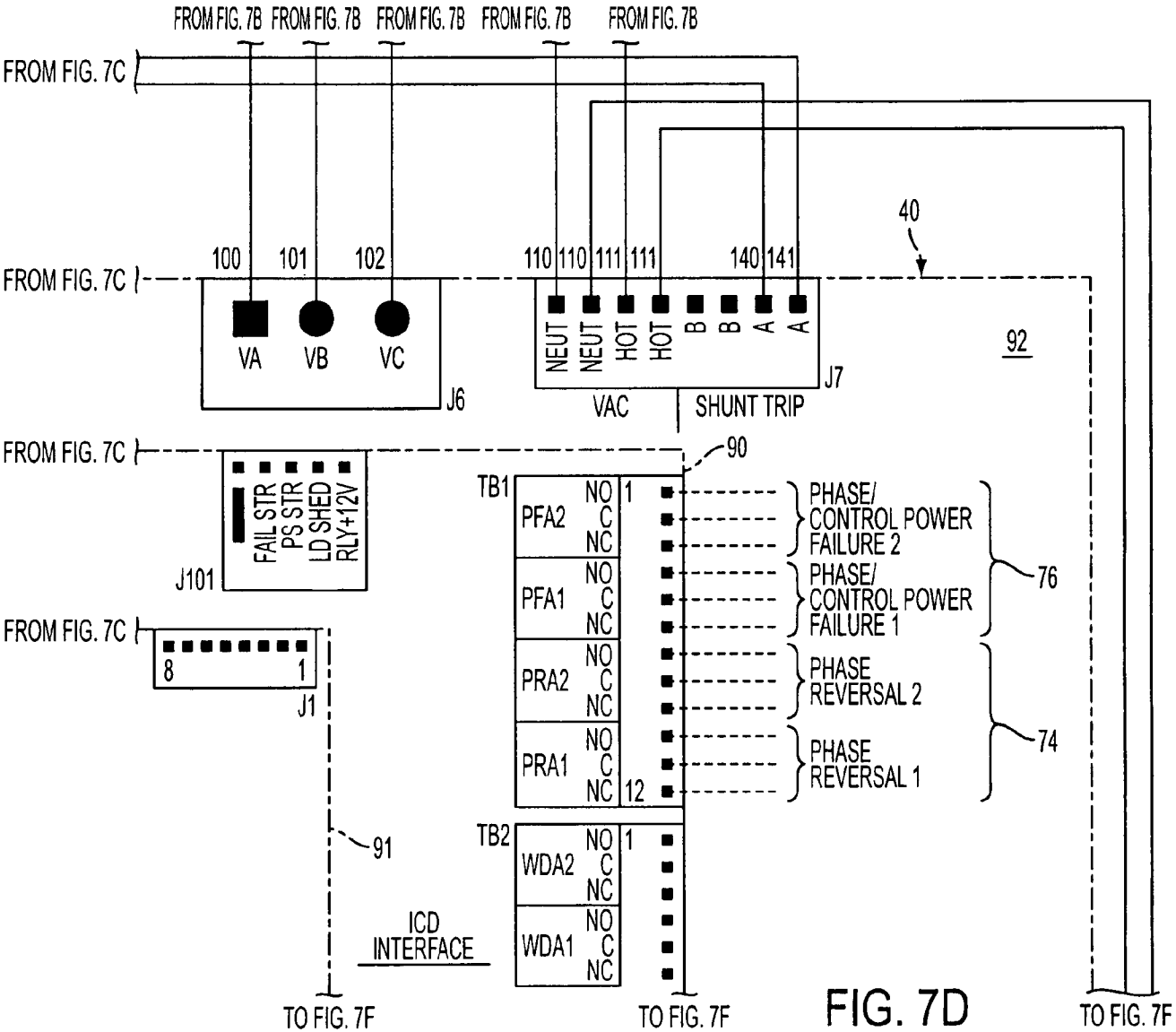
Figure 7E:
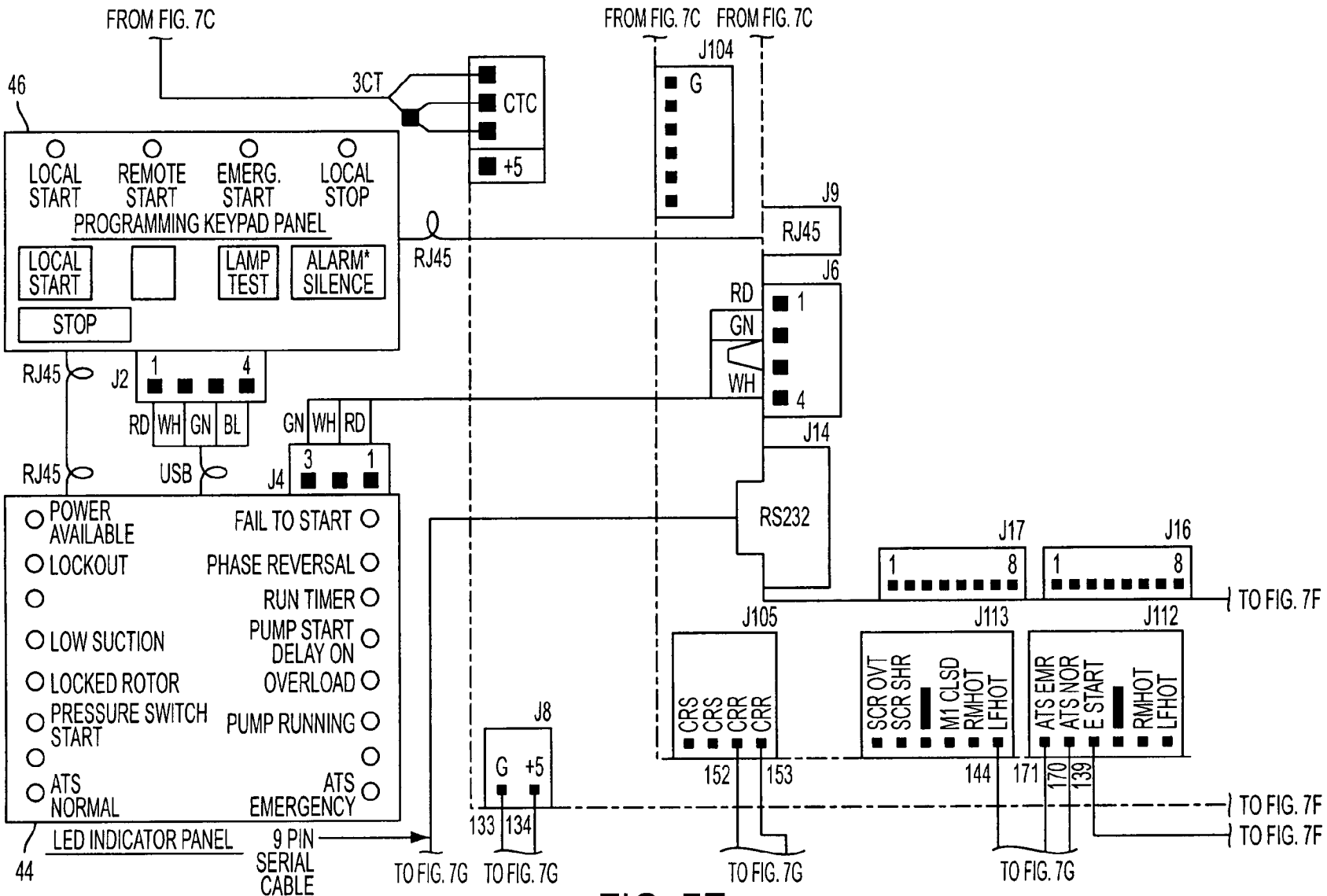
Figure 7F:
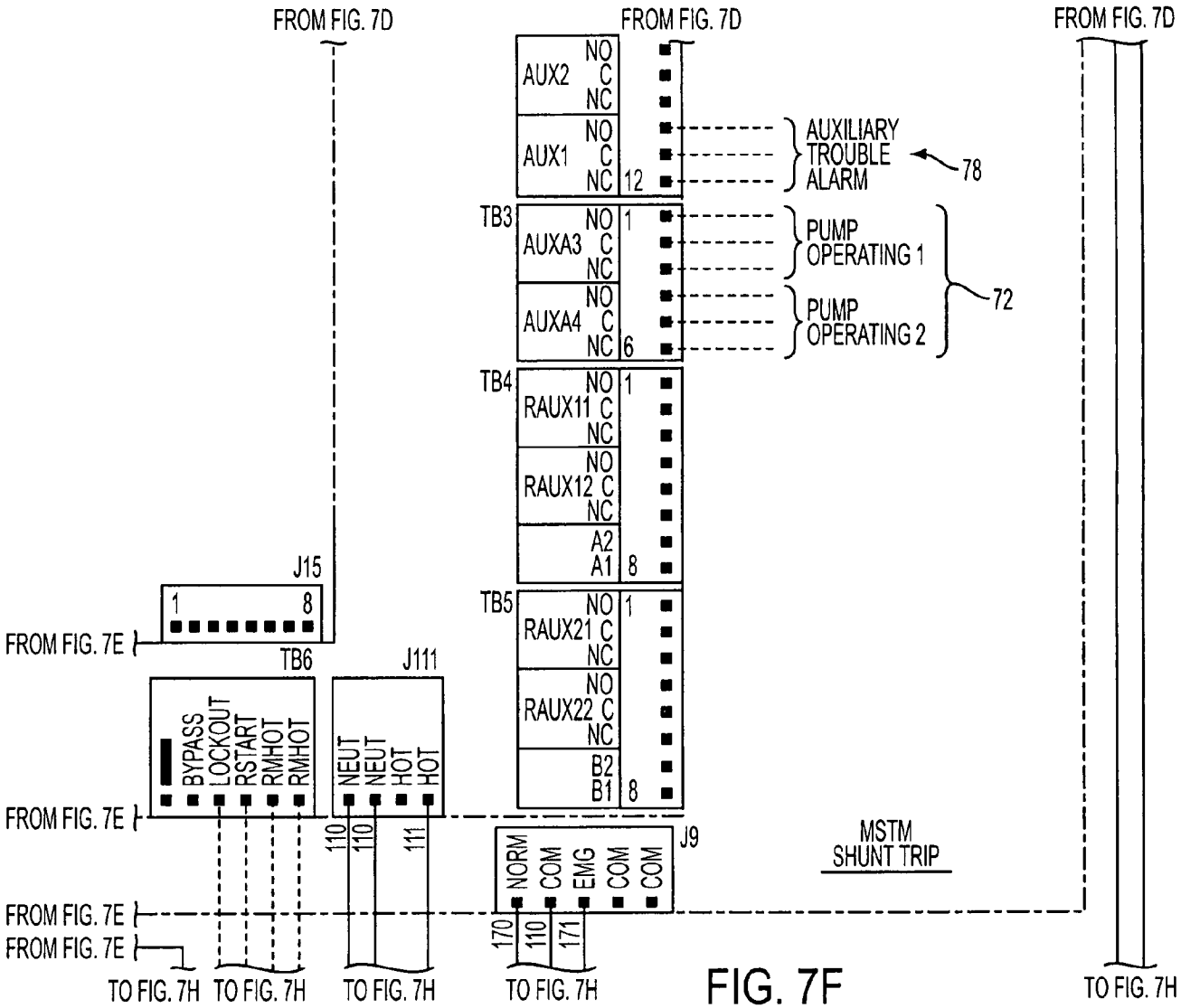
Figure 7G:
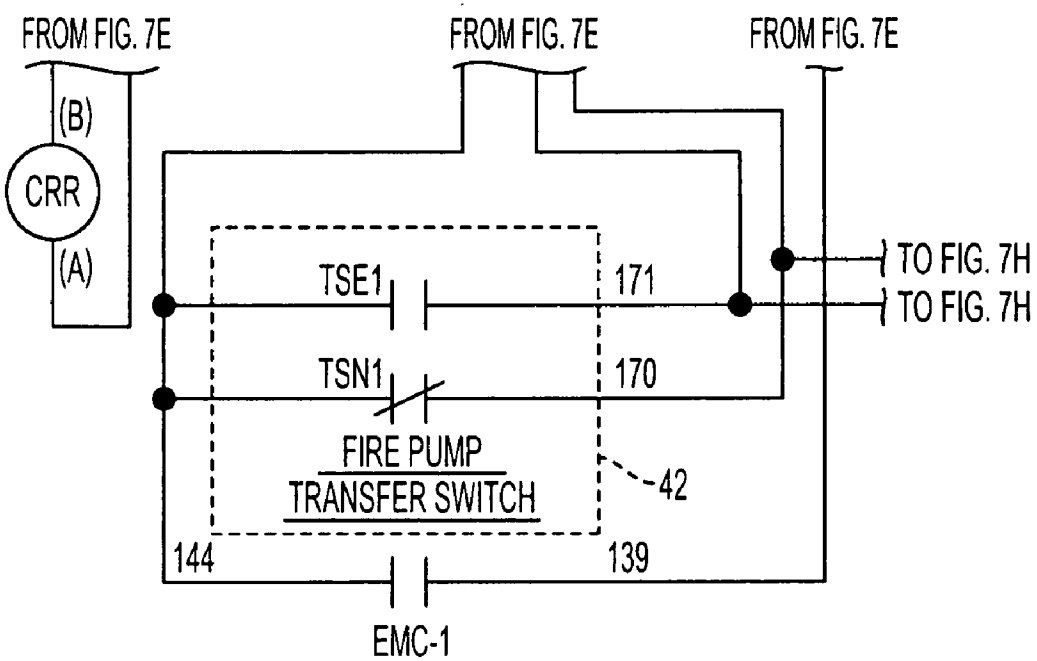
Figure 7G:
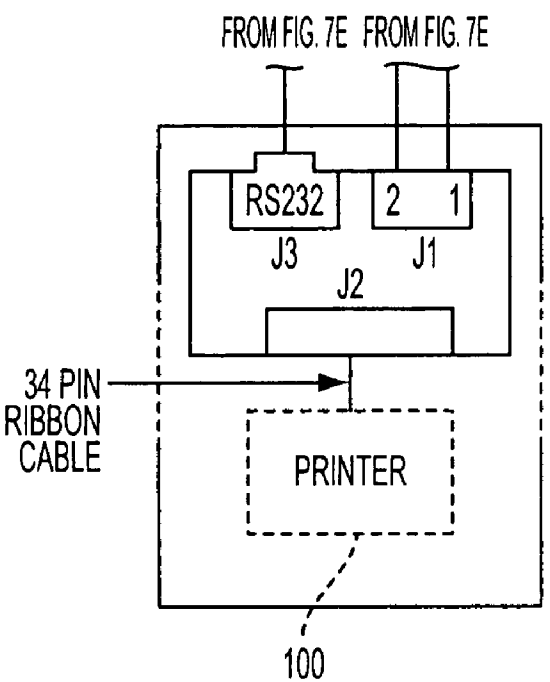
Figure 7H:
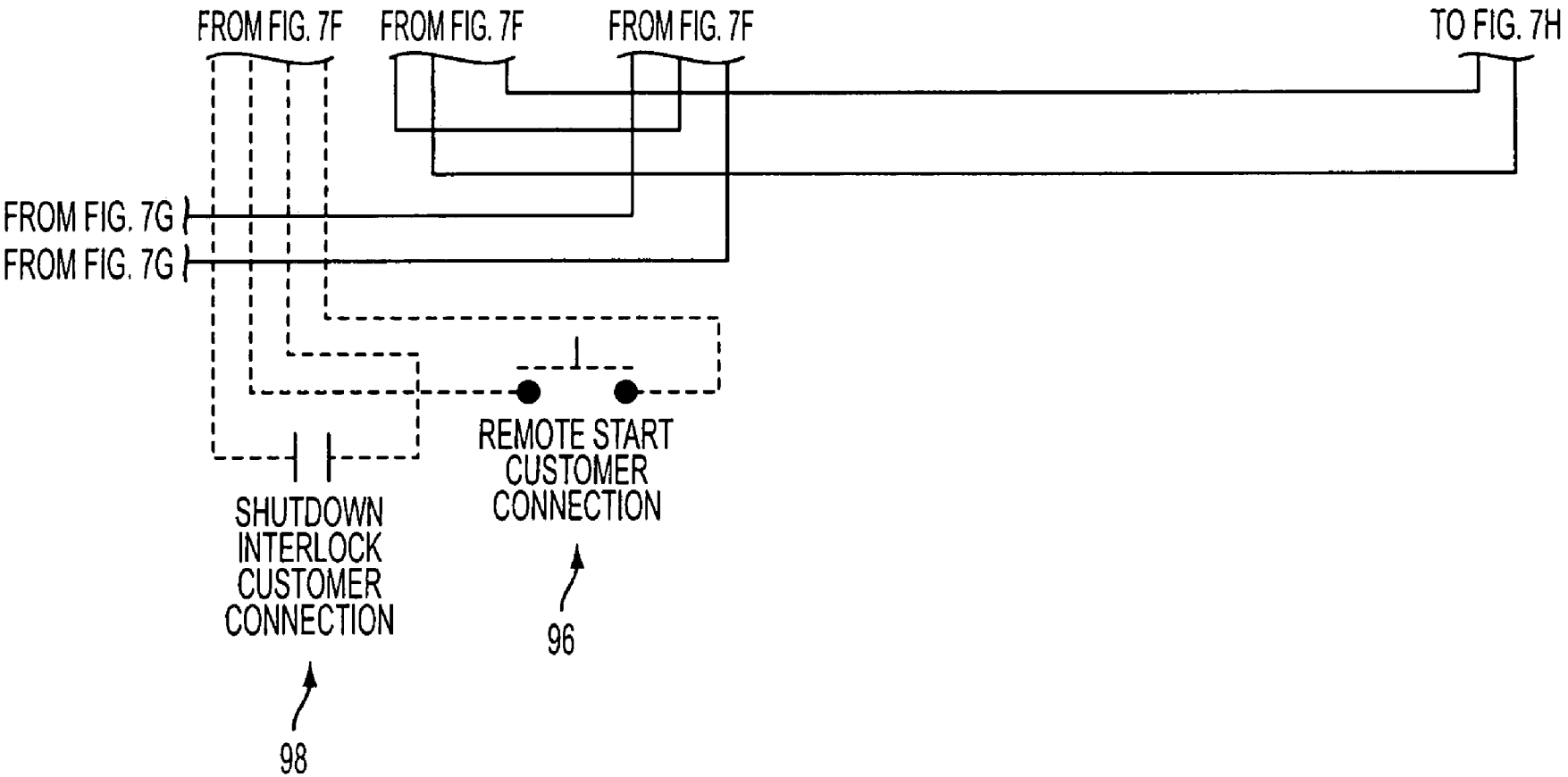

Referring to FIG. 2 and FIG. 4, the access door 28 supports an LED display module 44 for displaying various alarms and information indicators. In a preferred embodiment, 16 LED displays are provided on the module 44 to provide various alarm indications, as shown in FIG. 4. As shown in FIG. 5, an LCD display programming module 46 is also mounted on the access door 28 to allow programming by the operator. In the embodiment shown, the LCD display 82 provides different screen choices to provide various displays of the system such as for Local Manual Start, Remote Start, Emergency Manual Start and Local Manual Stop. A key pad 80 is also provided on the programming module 46 to program and set the system with desired functions.

Referring to FIG. 6, automatic transfer switch 42 includes a solid state transfer control module 52. Transfer control module 52 has voltage monitors 54 and voltage/frequency monitors 56 to monitor the electric power in the primary power lines 48 and detect changes therein as an indication of power failure or insufficient power for proper operation of the pump system of the fire suppression system. Transfer control module 52 is also connected to a transfer relay board 58 which is connected to a transfer switch control 60. Transfer control relay board 58 includes several transfer control relays and a time delay circuit. In the event of a detected power failure of the primary power source, insufficient power or a phase reversal, transfer control module 52 controls the initiation of operations by the transfer relay board 58 and transfer switch control 60 to actuate switches 62 to provide electrical power from the secondary source. Transfer control module 52 is also connected to contact 64 to start an internal combustion engine to run an auxiliary generator.

In the schematic diagram of FIG. 6 and FIGS. 6A-6F, the transformer connections are 50/60 hertz and the transformer connections connect per the voltage required. The TSN and TSE power poles are interlocked and PL 1 and PL 2 LED lights are located in the LED display of the fire pump microcontroller. The contacts are shown in a "no power" state with load connected to normal source where the TSN is activated. Table 1 identifies the symbols to assist in the understanding of FIG. 6.

TABLE 1

| Symbol | Description |
|---|---|
| Δ | operator provided for manual tansfer. |
| ⊗ | switches shown open to indicate that the EIS Circuit Breaker is open. |
| A1,A2 | Normal Side Control Power |
| AT1, AT2 | Normal Side Trip Control Power |
| AR | Alarm Relay |
| AR1 | Auxiliary Alarm Relay |
| B1, B2 | Emergency Side Control Power |
| BT1, BT2 | Emergency Trip Control Power |
| EIS | Emergency Isolator Switch |
| HORN | Horn |
| P83 | Test Pushbutton |
| P84 | By-Pass ReTransfer to Normal P.B. |
| PL1 | Normal Power LED Light, Green |
| PL2 | Emergency Power LED Light, Red |
| PL3 | Emergency Isolation Pilot Light, Amber |
| PRM | Phase Reversal Monitor |
| PT81, T88 | Terminal Block |
| SAS | Silence Alarm Switch |
| TCR | Transfer Control Relay |
| TCRB | Transfer Control Relay Board |
| TR | Time Delay Relay |
| TSN1, 2 | Normal Side Aux. Contacts |
| TSE 1, 2 | Emergency Side Aux. Contacts |
| XFMR1 | Normal Side Transformer |
| XFMR2 | Emergency Side Transformer |

As shown in the schematic diagram of FIG. 7 and FIGS. 7A-7H, fire pump controller 40 includes a microcontroller-based circuit board indicated generally at 91 that is programmed to operate the fire suppression system. As described in more detail below, microcontroller-based circuit board 91 is coupled to an input/output interface board indicated generally at 90 and a shunt trip board indicated at 92 which are collectively referred to as the backboard of the FPC 40. The FPC is connected to a pressure transducer 64 via the backboard to monitor pressure changes in the water pipes and to actuate electric motor 66 to drive the water pump of the fire suppression system. The FPC backboard is connected to the ATS 42 for essentially continuous operation in the event of failure of the primary power source.

The schematic diagram of FIG. 7 is shown in a "no power" state when normal water pressure is applied. The customer connections are shown by the dashed lines. The relay contacts are rated at 8 amps at 250 VAC. A minimum of 12" clearance must be maintained between the pump room floor and current carrying or live parts. The EMC-1 is normally closed and held open when "off".

Display panels 44 and 46 are mounted on the door 28 and connected to the microcontroller-based circuit board 91. Display panel 44 provides indicator lights 68 for indicating the status and operation of the fire suppression systems. Display panel 44 in the embodiment shown includes displays for indicating water pressure, water pump operation, and the operation of the electrical and power systems. Display panel 46 includes a key pad 80 for programming a microcontroller on the board 91 and overriding the automatic operation of microcontroller for manual testing and operation of the system. A visual display 82 is provided in display panel 46 to display the testing and operational features of the invention.

In operation, fire pump controller and transfer switch assembly 10 continuously monitors a building to operate the fire suppression system. When a fire occurs and actuates a sprinkler head, pressure in the sprinkler system drops below a threshold level which is sensed by the FPC 40. FPC 40 then actuates the pump motor to supply water to the sprinklers as needed.

The assembly 10 is connected to a fire pump motor for use in a building having a water supply for a fire protection system. The controller 40 of assembly 10 provides a soft start control of the fire pump motor. Generally, a normal operating water pressure is provided in the pipes of the fire prevention system. Controller 40 monitors the water pressure and compares the water pressure with a reference operating pressure. When a low pressure signal is indicated from a pressure sensor, controller 40 actuates the soft start of the fire pump motor. The fire pump motor is operated at full voltage in response to a low pressure signal for a selected period of time or until a high pressure signal is indicated. When the pressure in the system has been restored and a high pressure signal is indicated, the voltage to the pump can be decreased from full voltage to stop the motor. In the event the primary power source is interrupted, ATS 42 automatically switches to an alternative power source or actuates a generator to maintain the operation of the pump and maintain continuous monitoring of the building.

The schematic diagram in FIG. 7 illustrates the major components of the fire pump controller (FPC) 40 and the automatic transfer switch (ATS) 42 combination in the cabinet 12, as well as the motor 66 controlled by the FPC 40. A backboard is mounted in the top compartment 36 of the cabinet 12 which preferably comprises three circuit boards mounted on top of each other. The bottom and largest circuit board 92 is the micro shunt trip module (MSTM) comprising breaker/trip curves, current transformers for each of the monitored three phase lines of the normal power source and visual indicators of the amps and voltages on the three respective lines. An industrial control division (ICD) input/output interface 90 is mounted on the MSTM 92 that comprises relays for input and output control. The ICD interface 90 also exchanges information with the ATS 42. By way of an example, the ICD interface 90 comprises interface connections to a pressure transducer 64, to the pump 72, to a remote start customer connection device 96, to a shut down interlock customer connection device 98, as well as to the power control and transfer switch circuitry of the ATS 42. A standard product controller (SPC) board 91 is provided on the ICD interface board 90 and comprises connectors to the keypad 46 and the LED indicator panel 44, as well as to a printer 100 and main power source monitoring devices for amps and voltages on the three lines of the three phase power source, as indicated generally at 102. The SPC board includes ports for providing or collecting information such as pressure drops, phase or other power control variables and pump operation events such as dates and times when the pump(s) start and stop. Thus, event information can be dowloaded to a personal computer, for example.

With reference to FIG. 6, the automatic transfer switch (ATS) 42 comprises a solid state transfer control module (TCM) 52 which is preferably mounted on the inside of the door 28. TCM 52 monitors voltages and frequencies of the three phase main power source and provides signals to the transfer control relay board 58 to initiate transfer of power from the main power source to the auxiliary power source. The transfer switch control 60, in turn, completes power to a switch device indicated at TSN/TSE 62 having power contacts, as depicted in FIG. 6.

With continued reference to FIG. 6, the transfer control relay board 58, in response to control signals from the TCM 52, closes contacts associated therewith to complete power to the transfer switch control (TSC) 60 which is connected to the TSN/TSE power contacts. The TSC 60 has inputs with which to energize a solenoid to drive the contacts 62 open and closed respectively to switch from the normal power source to the emergency power source. The automatic transfer switch circuitry in the lower cabinet senses voltage and frequency in the power sources and upon detection of a selected condition such as loss of phase in one of the three legs of the main power source, the ATS 42 provides a signal to the microcontroller section of the FPC 40 to initiate operation of the generator and subsequent transfer of power from the main source to the auxiliary source when the generator has reached an acceptable operational level.

In accordance with the present invention, the location and placement of the backboard 92, isolating switch and circuit breakers 70 (FIG. 1), motor contactors 110 (FIG. 8), and power resistors 112, among other modules of the assembly 10, are advantageously selected to minimize the footprint of the cabinet 12, as well as to minimize the length of the power cables and therefore the deleterious effects of magnetics on the cables during a possible short circuit condition, to provide a more secure mounting of the power cables in the cabinet 12, and to minimize labor when assembling the cabinet 12. The transfer control module 52 is advantageously placed on the inside of the door 28 since there is no need to run power cables to this device, thereby minimizing the length of the power cable used and the occurrences of power cable and other wire crossings. Further, due to the significant size of the TCM 52 in relation to other cabinet components, the placement of the TCM 52 by mounting on the inside of the door 28 reduces the amount of area required by the transfer switch section 42 in a longitudinal cross-section of the cabinet 12 such as along the back wall 18.

Figure 8:
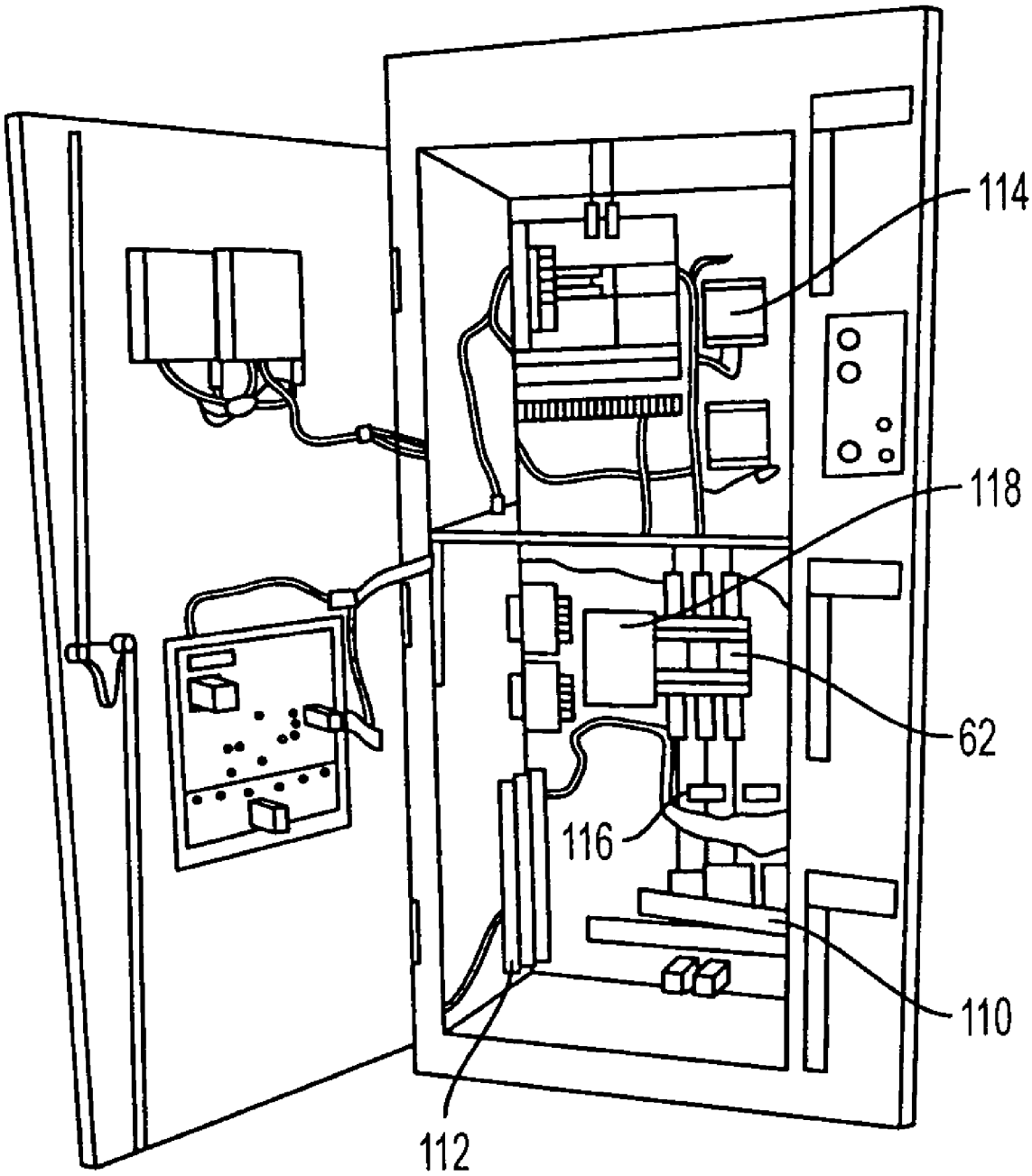
FIG. 8 is an isometric view of a fire pump controller and automatic transfer switch cabinet in accordance with an embodiment of the present invention.

The transfer control switch 60 comprises a power transfer module 116 and a driver 118 located in the compartments 36 and 38, respectively, as shown in FIG. 8. With reference to FIGS. 1, 7 and 8, the top compartment 36 preferably encloses the backboard 92, a phase monitor 114 and the power transfer module 116 corresponding the transfer switch control 60. The phase monitor 114 has connections to the ICD interface 90 to provide phase information to the microcontroller on the SPC board 91, as well as transformers 1 and 2 depicted in FIG. 6 for monitoring the normal power source and the emergency power source, respectively. The TSC 60 is typically located with the ATS circuitry in conventional transfer switch cabinets associated with existing and therefore separate fire pump controllers. In accordance with an aspect of the present invention, the transfer switch control 60 is located in the bottom compartment 42 to be proximal to the isolating switch and circuitry breaker indicated at 71 in FIGS. 1 and 3.

With continued reference to FIGS. 1 and 8, the cabinet 12 preferably has two openings for receiving power cables from the primary power source (e.g., utility power cables) and an auxiliary source (e.g., cables from a secondary utility power source or a generator) connected to respective circuit breakers 70 and isolation switch 71 located in the top and bottom compartments, respectively. The circuit breakers 70, 71, transfer switch 62, and motor contactors 110 are substantially vertically arranged with respect to each other and located substantially on one side of the cabinet 12 to minimize the length of the power cables that interconnect them and to allow for more secure mounting of same within the cabinet 12. To further minimize the footprint of the transfer switch components, power resistors 112 are provided in the bottom compartment 38 in accordance with the present invention. Such power resistors are typically provided in a separate cabinet in conventional fire pump controller and automatic transfer switch cabinet combinations. With reference to FIG. 8, the placement of the LED indicator display 44, keypad 46, and transfer control module 52 on the inside of the door 28 and substantially proximal to their respective first and second compartments 36 and 38 minimizes the lengthwise cross-sectional area needed in the cabinet 12 for both the fire pump controller 40 circuitry and the transfer switch components 42. The remaining fire pump controller and transfer switch components located essentially along the back wall 18 of the cabinet are arranged in a way to minimize wire stress, minimize the length of power cable runs, and reduce labor needed to assemble the contents of the cabinet 12.

While various embodiments have been disclosed herein, it will be understood that various changes and modifications can be made to the invention without departing from the spirit and scope of the invention.

What is claimed is:

1. A fire pump control assembly comprising:

a metal fire resistant cabinet having a first side wall, a second side wall, a top wall extending between said side wall, a rear wall defining a first compartment and second compartment;

a door coupled to said cabinet for simultaneously closing said first and second compartments;

a fire pump control device housed completely within said first compartment; and a control pad mounted on said door and being accessible through an outer side of said door, and connected to said fire pump control device, a display module mounted on said door and accessible through the outer side of the door and connected to the fire pump control device;

an automatic transfer switch assembly housed completely within said second compartment and being operatively connected to said fire pump control device and where said fire pump control device and automatic transfer switch are positioned to minimize cable run and minimize wire stress between said fire pump control device and automatic transfer switch, and a transfer control module mounted on an inner side of said door and aligned with said second compartments, said transfer control module being connected to said automatic transfer switch assembly to provide electric power from a secondary power source.

2. The fire pump control assembly of claim 1, wherein said intermediate wall forms a fire resistant barrier between said first compartment and said second compartment.

3. The fire pump control assembly of claim 2, wherein said door has a length and width to close said first and second compartments and to cooperate with said intermediate wall to separate said first compartment from said second compartment.

4. The fire pump control assembly of claim 3, wherein said fire pump control device includes a microprocessor to control a supply of electric power to an electric motor connected to a fire pump for supplying water to a fire suppression system.

5. The fire pump control assembly of claim 4, wherein said automatic transfer switch includes a microprocessor and is operatively connected to a first power source and to a second power source, said microprocessor automatically transferring electric power from said first power source to said second power source in the event of failure of said first power source.

6. The fire pump control assembly of claim 5, wherein said second power source is a generator and wherein said microprocessor actuates said generator in the event of failure of said first power source.

7. The fire pump control assembly of claim 2, wherein said intermediate wall extends between said side walls and where said fire pump control device and said automatic transfer switch are connected by a cable extending through said intermediate wall.

8. The fire pump control assembly of claim 4, wherein said microprocessor of said fire pump control device provides a soft start and a soft stop of said electric motor of said pump.

9. An automatic, self contained fire pump assembly for operating an electric motor coupled to a water pump for supplying water to a fire suppression system of a building, said assembly comprising:

a fire resistant cabinet having first and second side walls, a top wall, a bottom wall and a back wall with an open front side, and an intermediate wall extending between said side walls and defining a first fire resistant compartment and a second fire resistant compartment wherein said first compartment is separate from said second compartment;

a door coupled to said cabinet for closing said open front side and said first and second compartments;

a fire pump control device completely housed in said first compartment for controlling electric power to said electric motor of said fire suppression system; and a transfer switch assembly completely housed in said second compartment for continuously maintaining an electric power supply to said control device and the electric motor, said transfer switch being operatively connected to said control device and a transfer control module mounted on an inner side of said door and aligned with said second compartment, said transfer control module being connected to said transfer switch assembly to provide electric power from a secondary power source.

10. The fire pump assembly of claim 9, wherein said first compartment is stacked on top of said second compartment.

11. The fire pump assembly of claim 9, wherein said door has a width and a height corresponding to a dimension of said open front side and where said door closes said first and second compartments.

12. The fire pump assembly of claim 9, wherein said intermediate wall defines a first resistant barrier between said first compartment and said second compartment.

13. The fire pump assembly of claim 9, wherein said fire pump control device comprises a microprocessor to control said electric power to said electric motor of said water pump.

14. The fire pump assembly of claim 9, wherein said transfer switch assembly includes a microprocessor operatively connected to a first electric power source and to a second electric power source, said microprocessor selectively supplying electric power from said first and second power source to said fire pump control device and to said electric motor of said pump.

15. The fire pump assembly of claim 14, wherein said transfer switch automatically transfers electric power from said first power source to said second power source in the event of failure of said first power source.

16. The fire pump assembly of claim 14, wherein said second power source is a generator and wherein said transfer switch actuates said generator to supply electric power to said control device and to said electric motor of said pump in the event of failure of said first power source.

17. The fire pump assembly of claim 9, further comprising a control pad mounted on said door and being accessible through the outer side of said door and connected to said fire pump control device, and a display module mounted on said door and accessible through the outer side of said door and connected to the fire pump control device.

18. A unitary cabinet having a door and first and second fire resistant compartments for housing a fire pump controller (FPC) and an automatic transfer switch (ATS), respectively, that are separated by a dividing member, the cabinet further comprising a transfer switch controller comprising components in both compartments, the components comprising:

a transfer switch power transfer module located in the first compartment and operable to receive control signals from a processing device in the FPC located in the second compartment;

a control pad mounted on said door and being accessible through an outer side of said door and connected to said fire pump controller, and a display module mounted on said door and accessible through the outer side of the door and connected to the fire pump controller, a driver module located in the second compartment and connected to the transfer switch for driving the contacts thereof, the contacts being configured to selectively open and close to switch power between a primary power source and a secondary power source, the driver being controllably operated by said transfer switch power transfer module, and a transfer control module mounted on an inner side of said door and aligned with the second compartment, said transfer control module being connected to said automated transfer switch to provide electric power from a secondary power source.

19. A unitary cabinet having a door and first and second fire resistant compartments for housing a fire pump controller (FPC) and an automatic transfer switch (ATS), respectively, that are separated by a dividing member, the cabinet further comprising:

a circuit breaker connected to a primary power source;

motor contactors;

and a transfer switch controller for switching power from the primary power source to a secondary power source, the transfer switch controller being connected between the circuit breaker and the motor contactors via power cables;

said transfer switch controller including a transfer control module mounted to an inner side of said door in said second compartment, and wherein said circuit breaker, said transfer switch controller and said motor contactors being mounted in said cabinet substantially vertically with respect to each other.

20. A cabinet as in claim 19, wherein said circuit breaker, said transfer switch controller and said motor contactors are mounted proximal to a side wall of the cabinet.

21. The cabinet of claim 19, further comprising a control pad mounted on said door and being accessible to an outer surface of said door and being connected to said fire pump controller, and a display module on said door and being accessible to the outer surface of said door and being connected to fire pump controller.

* * * * *